US011131066B2

(12) United States Patent
Benjamin et al.

(10) Patent No.: US 11,131,066 B2
(45) Date of Patent: Sep. 28, 2021

(54) RAILROAD SPIKE REMOVER

(71) Applicant: Focused Technology Solutions, Inc., Rockaway, NJ (US)

(72) Inventors: Timothy J. Benjamin, Newnan, GA (US); Peter M. Bartek, Ledgewood, NJ (US); Corey Dash, Mount Arlington, NJ (US); Laura Ann Ruhala, Powder Springs, GA (US); Kristopher Andre Alonzo, Lawrenceville, GA (US); Trevor Lee-Michael Barnby, Tallapoosa, GA (US); Samuel Horace Gantt, Marietta, GA (US); Daniel Richard Scott, Kennesaw, GA (US)

(73) Assignee: Focused Technology Solutions, Inc., Hackettstown, NJ (US)

( * ) Notice: Subject to any disclaimer, the term of this patent is extended or adjusted under 35 U.S.C. 154(b) by 0 days.

(21) Appl. No.: 16/734,125

(22) Filed: Jan. 3, 2020

(65) Prior Publication Data

US 2020/0141064 A1 May 7, 2020

Related U.S. Application Data

(63) Continuation-in-part of application No. 15/175,900, filed on Jun. 7, 2016, now Pat. No. 10,597,828.
(Continued)

(51) Int. Cl.
*E01B 29/26* (2006.01)

(52) U.S. Cl.
CPC ..... *E01B 29/26* (2013.01)

(58) Field of Classification Search
CPC ..... E01B 29/26; E01B 29/00; B25C 11/00
See application file for complete search history.

(56) References Cited

U.S. PATENT DOCUMENTS 577,783 A 2/1897 Powell
737,530 A 8/1903 Tillberg
(Continued)

FOREIGN PATENT DOCUMENTS

CA 2969795 A1 12/2017
DE 520526 C 3/1931
(Continued)

OTHER PUBLICATIONS

Mar. 18, 2020—(EP) EESR—App. No. 19216949.8.
(Continued)

*Primary Examiner* — David P Bryant
*Assistant Examiner* — Nirvana Deonauth
(74) *Attorney, Agent, or Firm* — Arnold & Porter Kaye Scholer

(57) ABSTRACT

A portable railroad spike remover comprises a claw assembly extractor that is shaped to engage and secure a railroad spike previously installed into a rail tie. The claw assembly extractor may include a pair of jaw members that are pivotally connected to each other by a pivoting pin and a rotating pin. Each jaw member may include a lower end configured to contact and secure a railroad spike and a pair of upper members interlocked with each other and pivotally connected to the clevis fastener with the rotating pin. When the drive shaft is rotated, the claw assembly extractor and the mounting flange may move inside the main housing in a vertical direction to extract the railroad spike from the rail tie.

22 Claims, 32 Drawing Sheets

Related U.S. Application Data

(60) Provisional application No. 62/788,925, filed on Jan. 6, 2019.

(56) References Cited

U.S. PATENT DOCUMENTS

| | | | | |
|---|---|---|---|---|
| 1,830,269 | A | 11/1931 | Ford | |
| 2,639,887 | A * | 5/1953 | Henry | B25C 11/02 254/19 |
| 2,691,505 | A | 10/1954 | Hursh | |
| 2,735,649 | A * | 2/1956 | Swallert | B25C 11/02 254/18 |
| 3,594,890 | A * | 7/1971 | Cordell | B25B 27/064 29/255 |
| 3,830,633 | A | 8/1974 | Harbottle | |
| 4,273,052 | A | 6/1981 | Woolner et al. | |
| 4,538,793 | A | 9/1985 | Dieringer et al. | |
| 4,579,061 | A | 4/1986 | Dieringer | |
| 4,928,600 | A | 5/1990 | Urmson, Jr. et al. | |
| 5,465,667 | A | 11/1995 | Hosking et al. | |
| 5,924,679 | A | 7/1999 | Wilson | |
| 6,095,053 | A | 8/2000 | Johnsen et al. | |
| 6,098,960 | A * | 8/2000 | Lefavour | E01B 29/26 254/18 |
| 6,113,073 | A | 9/2000 | Lefavour et al. | |
| 6,718,851 | B1 | 4/2004 | Peggion | |
| 7,353,757 | B2 | 4/2008 | Eldridge | |
| 8,371,556 | B2 | 2/2013 | Price | |
| 8,485,103 | B2 | 7/2013 | Miller et al. | |
| 9,637,867 | B2 | 5/2017 | Burns | |
| 9,839,999 | B2 * | 12/2017 | Kittell | B25B 7/14 |
| 2007/0113752 | A1 | 5/2007 | Eldridge | |
| 2009/0236572 | A1 | 9/2009 | Laun | |
| 2011/0067528 | A1 | 3/2011 | Price | |
| 2012/0199037 | A1 | 8/2012 | Miller et al. | |
| 2013/0240806 | A1 | 9/2013 | Crover | |
| 2016/0023873 | A1 | 1/2016 | Kasan | |
| 2016/0040365 | A1 | 2/2016 | Burns | |
| 2017/0058461 | A1 | 3/2017 | Weatherill et al. | |
| 2017/0350078 | A1 | 12/2017 | Benjamin et al. | |

FOREIGN PATENT DOCUMENTS

| | | | |
|---|---|---|---|
| EP | 1041203 | A1 | 10/2000 |
| EP | 3255207 | A1 | 12/2017 |
| GB | 168101 | A | 9/1921 |
| GB | 794433 | A | 5/1958 |

OTHER PUBLICATIONS

May 12, 2020—(EP) EESR—App. No. 20150387.7.

Nov. 3, 2017—(EP) ESSR—App. No. 17174787.6.

Stanley Hydraulic Spike Puller SPL31 A-Nm SPL31A-S User Manual, Black & Decker, Inc. (2013).

* cited by examiner

RAILROAD SPIKE REMOVER

The application is a continuation-in-part application of U.S. Non-Provisional application Ser. No. 15/175,900, filed Jun. 7, 2016 and claims benefit to U.S. Provisional Application No. 62/788,925, filed Jan. 6, 2019, all of which are herein incorporated by reference in their entirety.

FIELD OF INVENTION

The field of invention for this disclosure relates to a portable railroad spike remover.

BACKGROUND

Removing railroad spikes from a rail tie has not changed much over time. Railroad spikes are often removed from a rail tie manually using a crowbar. A railroad spike may need as much as 5,000 pounds of vertical force to remove a spike embedded in a rail tie. A portable device to easily remove the railroad spikes would be a great improvement.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

The present disclosure provides an apparatus for removing railroad spikes from a rail tie that is portable and easy to use.

According to one aspect of the disclosure, an apparatus for removing a railroad spike from a rail tie comprises: a main housing that includes an upper housing and a lower housing, wherein the upper housing includes a bearing housing that contains one or more bearings; a drive shaft connected to the main housing and a mounting flange, the drive shaft extending through the one or more bearings and an opening in the bearing housing; and a plurality of standoffs with a first end and a second end, with the first end of the plurality of standoffs connected to the mounting flange and the second end of the plurality of standoffs connected to a clevis pivot plate with a clevis fastener that is connected to a claw assembly extractor. The claw assembly extractor may include a pair of jaw members that are pivotally connected to each other by a pivoting pin and a rotating pin. Each jaw member may include a lower end and a pair of upper members interlocked with each other. The lower end may be configured to contact and secure a railroad spike and the pair of upper members may be pivotally connected to the clevis fastener with the rotating pin. When the drive shaft is rotated, the claw assembly extractor and the mounting flange may move inside the main housing in a vertical direction to extract the railroad spike from the rail tie.

According to another aspect of the disclosure, an apparatus for removing a railroad spike from a rail tie comprises: a main housing that includes an upper housing and a lower housing, wherein the upper housing includes a bearing housing that contains one or more bearings; a drive shaft connected to the main housing and a mounting flange, the drive shaft extending through the one or more bearings and an opening in the bearing housing; a T-handle assembly to hold a battery-operated drill-type tool that connects to the drive shaft, wherein the T-handle assembly includes one or more fastening straps and one or more side plates to connect the T-handle assembly to the main housing; and a plurality of standoffs with a first end and a second end, with the first end of the plurality of standoffs connected to the mounting flange and the second end of the plurality of standoffs connected to a clevis pivot plate with a clevis fastener that is connected to a claw assembly extractor. The claw assembly extractor may include a pair of jaw members that are pivotally connected to each other by a pivoting pin and a rotating pin. Each jaw member may include a lower end and a pair of upper members interlocked with each other. The lower ends may be configured to contact and secure a railroad spike and the pair of upper members may be pivotally connected to the clevis fastener with the rotating pin. The claw assembly extractor may include a friction assembly that includes a spring and one or more friction caps to keep the jaws in an open position as the jaws are moved from an up position to a home position after a railroad spike has been pulled. When the drive shaft is rotated, the claw assembly extractor and the mounting flange moves inside the main housing in a vertical direction to extract the railroad spike from the rail tie.

According to another aspect of the disclosure, the rail spike remover may include a rail spike driver for driving the railroad spike into the rail tie. The rail spike driver may be interchangeable with the claw assembly extractor by removing the clevis pivot plate and attaching the rail spike driver to the plurality of standoffs.

According to yet another aspect of the disclosure the rail spike remover may include a rectangular leveling block located on a side of a bottom footer of the lower housing of the main housing, wherein the leveling block is utilized to level the main housing and the rail spike remover when removing railroad spike.

BRIEF DESCRIPTION OF THE DRAWINGS

The present invention is illustrated by way of example and not limited in the accompanying figures in which like reference numerals indicate similar elements and in which.

Figure 1:
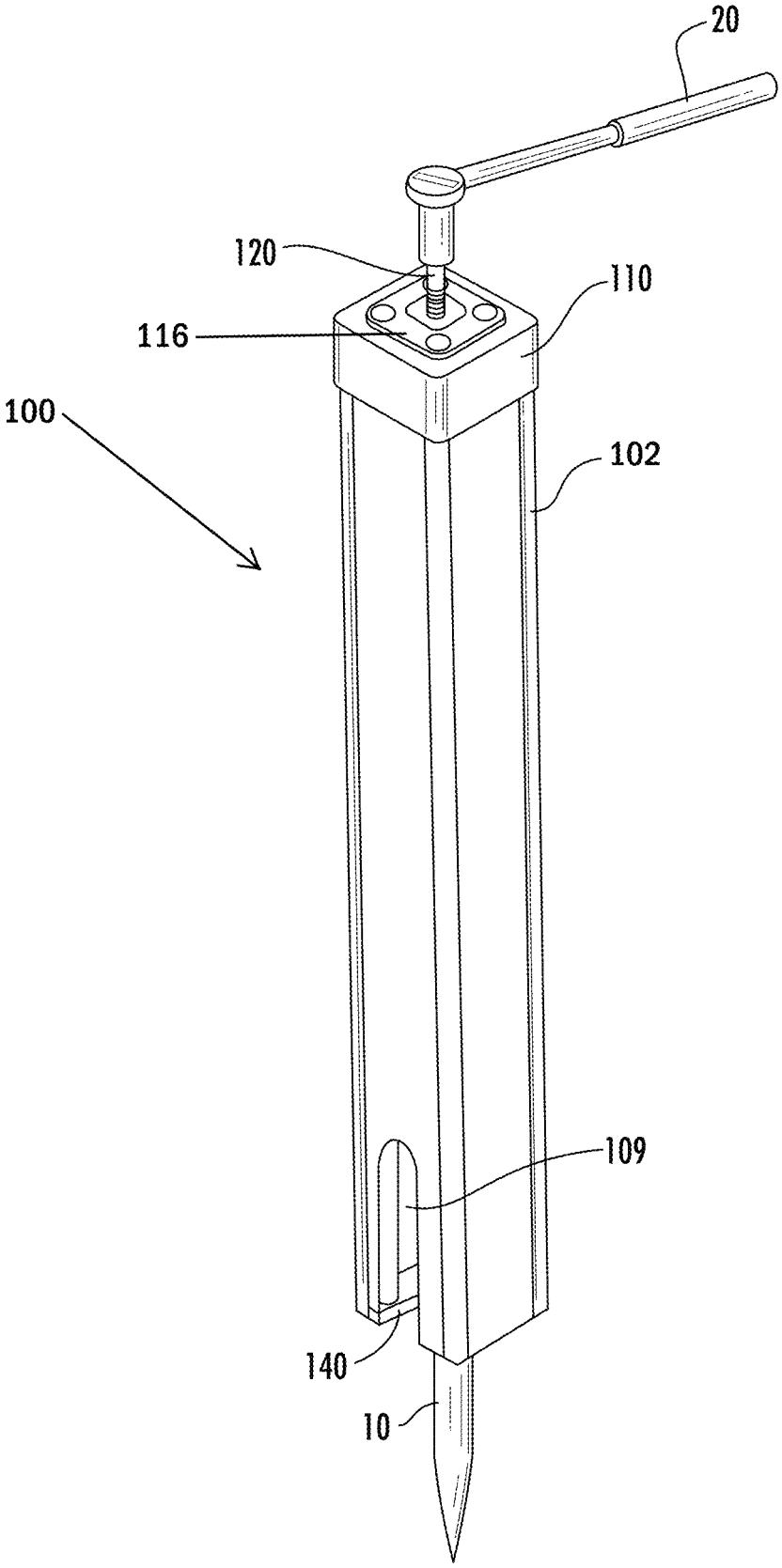
FIG. 1 illustrates a top front perspective view of an example embodiment of a rail spike remover according to one or more aspects described herein.

Further, it is to be understood that the drawings may represent the scale of different components of one single embodiment; however, the disclosed embodiments are not limited to that particular scale.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Nothing in this specification should be construed as requiring a specific three-dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Plurality," as used herein, indicates any number greater than one, either disjunctively or conjunctively, as necessary, up to an infinite number.

"Connected," as used herein, indicates that components may be connected directly being physically contacting each other or connected indirectly where the components are connected indirectly where the components do not physically contact, but have one or more intermediate components positioned between them.

"Integral joining technique" or means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto. Pieces joined with such a technique are described as "integrally joined."

In the following description of the various embodiments, reference is made to the accompanying drawings, which form a part hereof, and in which is shown, by way of illustration, various embodiments in which aspects of the disclosure may be practiced. It is to be understood that other embodiments may be utilized and structural and functional modifications may be made without departing from the scope and spirit of the present disclosure.

In general, as described above, aspects of this invention relate to an apparatus to remove railroad spikes from a rail tie comprising a main column, a drive shaft and an extractor. More detailed descriptions of aspects of this invention follow.

Figure 2:
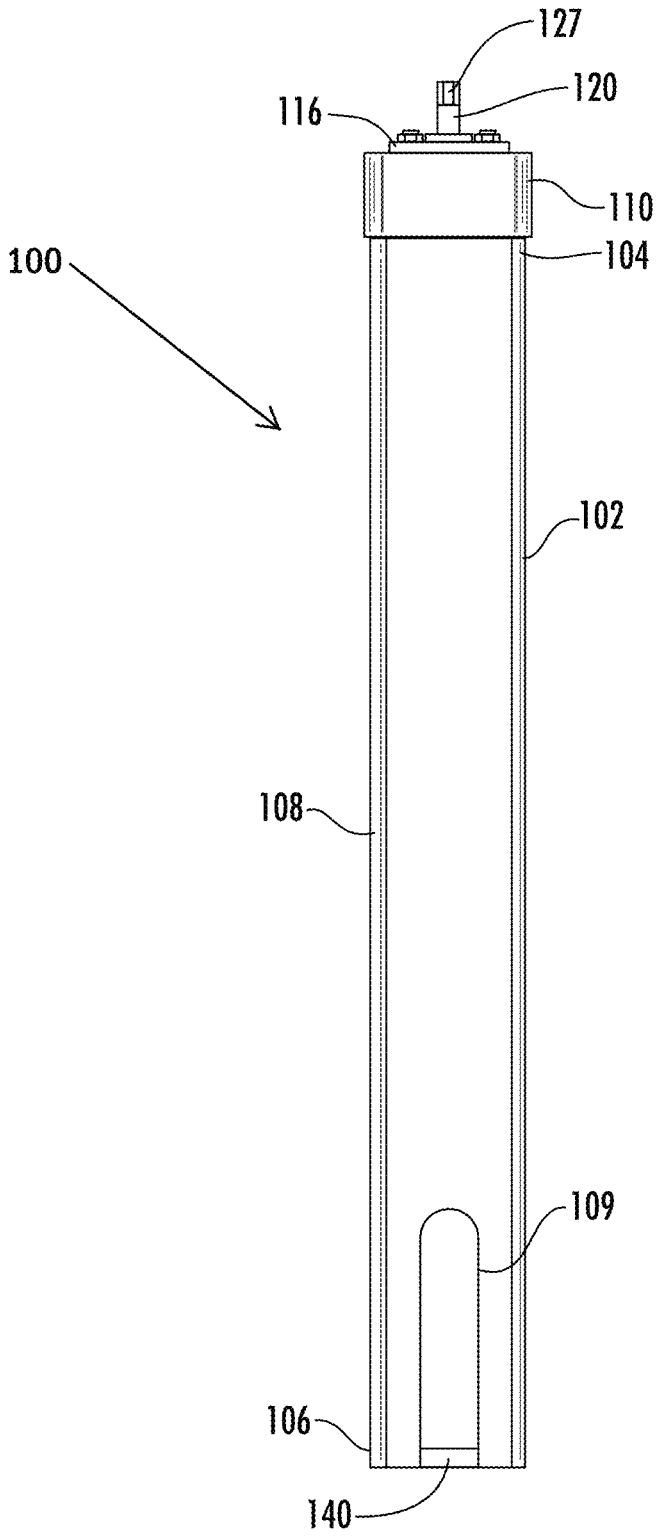
FIG. 2 illustrates a front view of the example embodiment of the rail spike remover of FIG. 1.
Figure 3:
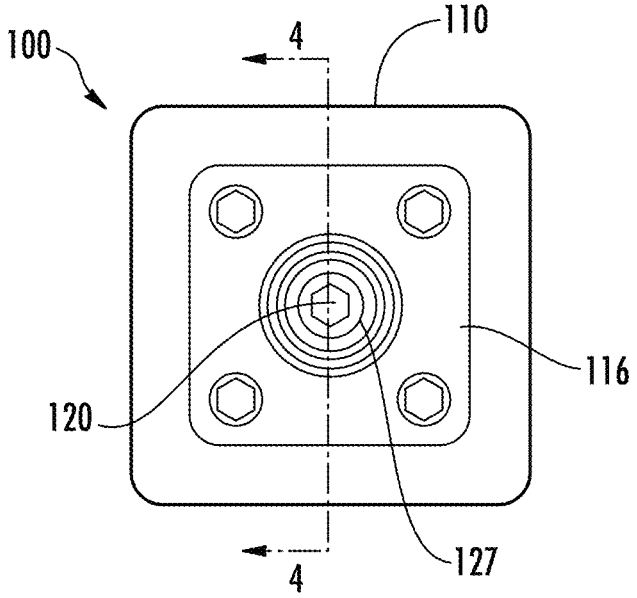
FIG. 3 illustrates a top view of the example embodiment of the rail spike remover of FIG. 1.
Figure 4:
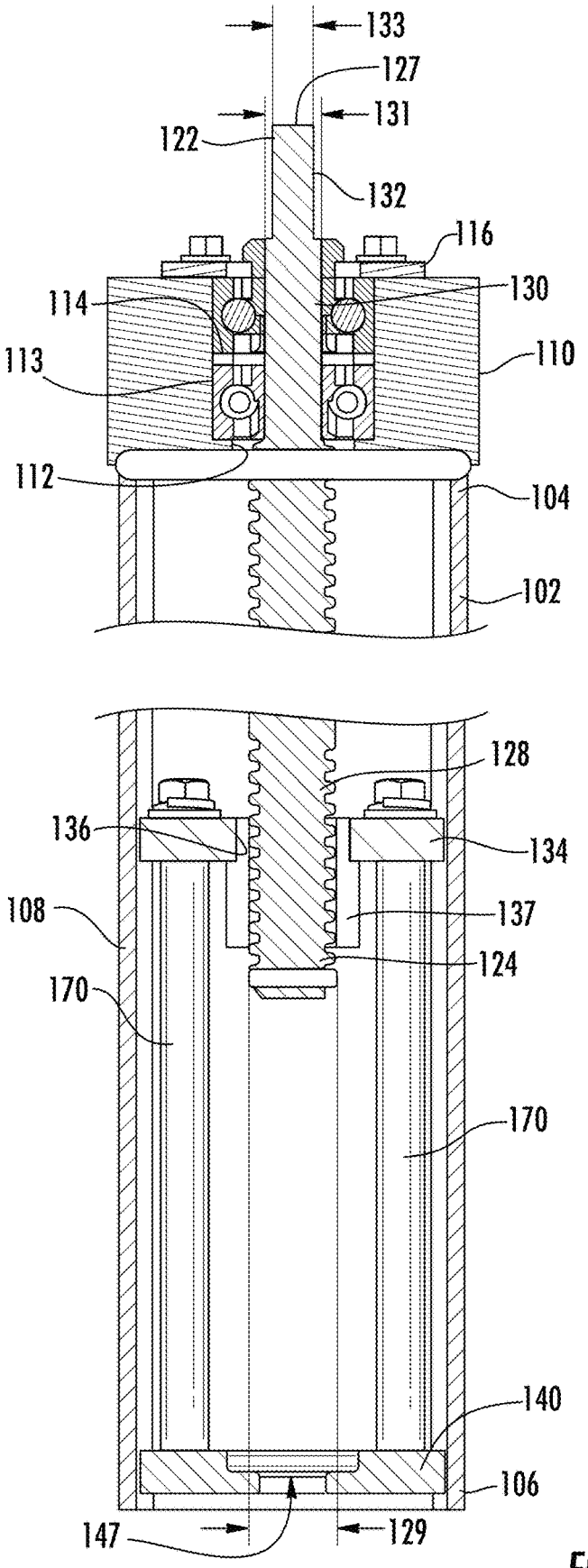
FIG. 4 illustrates a cross-sectional view of the example embodiment of the rail spike remover of FIG. 1.

One aspect of this invention relates to a portable railroad spike remover 100, as shown in FIGS. 1-4. Specifically, FIG. 1 illustrates a top front perspective view of an example embodiment of a railroad spike remover 100. FIG. 2 illustrates a front view of the railroad spike remover 100. FIG. 3 illustrates a top view of the railroad spike remover 100. FIG. 4 illustrates a cross-sectional view of the railroad spike remover 100. The railroad spike remover 100 may comprise a main column 102, a bearing housing 110, a plurality of standoffs 170, a mounting flange 134, an extractor 140, and a drive shaft 120. The main column 102 may have a first end 104, a second end 106 opposite the first end 104, and a center section 108 positioned between the two ends. The bearing housing 110 may be connected to the first end 104 of the main column 102 and have an opening 112 for inserting the drive shaft 120. The drive shaft 120 may also extend through a bearing 114 secured in the bearing housing 110 by a cap plate 116.

As illustrated in FIG. 4, the drive shaft 120 may have a first end 122 and a second end 124 opposite the first end 122. Near the first end 122, the drive shaft 120 may extend through an opening in the bearing 114, through an opening 112 in the bearing housing 110, and through an opening in the cap plate 116. Near the second end 124, the drive shaft 120 may connect to the mounting flange 134. The drive shaft 120 may be secured to the mounting flange 134 using a nut 137.

The plurality of standoffs 170 may connect to the mounting flange 134 at one end and to the extractor 140 at the opposite end. Alternatively, the drive shaft 120 may connect directly to the extractor 140 without the need for the mounting flange 134 and the plurality of standoffs 170. The extractor 140 may engage and grip the railroad spike 10 to secure it. Once the extractor 140 secures the railroad spike 10, a user may engage the first end 122 of the drive shaft 120 with a tool to provide torque to the drive shaft 120. As the drive shaft 120 is rotated, the mounting flange 134 and the extractor 140 may move inside the column in a vertical direction to extract the railroad spike 10 from a rail tie. As the extractor 140 moves up within the main column 102, the railroad spike 10 is removed from the rail tie.

The main column 102 may have a plurality of substantially vertical side walls that are open at both ends 104, 106. The main column may have a height of approximately 32 inches or within a range of 24 to 40 inches or any height. As shown in the exemplary embodiment shown in FIGS. 1-9, the main column 102 may generally have a square cross-sectional shape. However, the main column may have any geometric cross-sectional shape, such as circular, triangular, such that the main column 102 may have any number of side walls. For example as shown in FIGS. 1 and 3, the main column 102 may have four side walls, but may have 3 side walls, 5 side walls, 6 side walls or any number of side walls. The side walls may have a thickness of approximately 0.188 inches or within a range of 0.125 inches to 0.25 inches, or within a range of 0.06 inches to 0.375 inches. Each side wall may have a width of approximately 4 inches or within a range of 3 inches to 5 inches, or within a range of 2 inches to 6 inches.

As shown in FIG. 2, at least one side wall of the main column 102 may have an aperture 109 that extends from the second end 106 to a portion of the height of the main column 102. For example, the aperture 109 may have a height of approximately 20 percent of the height of the main column 102 or the aperture 109 may have a height that is within a range of 12 percent to 37 percent of the height of the main column. The aperture 109 may have an elongated shape and may have a height of approximately 7 inches or may be within a range of 5 inches to 9 inches. In addition, the aperture 109 may have a width of approximately 1.5 inches or within a range of 1.0 inch to 2.5 inches. The aperture 109 may align with the opening 147 of the extractor 140 to allow the railroad spike remover 100 to slide into position to engage the railroad spike 10 with the extractor 140.

The bearing housing 110 may be integrally joined to the first end 104 of the main column 102. Alternatively, the bearing housing 110 and main column 102 may be formed as a single piece. As previously discussed, the bearing housing 110 may have an opening 112. The opening 112 may be located in the geometric center of the bearing housing 110 and may have a cylindrical shape to allow the drive shaft 120 to extend through the bearing housing 110. The opening 112 may be through both ends of the bearing housing 110. In addition, the bearing housing 110 may have a cavity 113 that is concentric with the opening 112. The cavity 113 may be sized to contain the bearing 114 and have a cylindrical shape that is open at one end with a surface at the opposite end to engage one end of the bearing 114. The bearing housing 110 may also have a plurality of holes around the perimeter of the housing. The plurality of holes may be threaded to releasably connect the cap plate 116. The bearing 114 may be a roller bearing or bushing that enables the drive shaft 120 to rotate freely when the bearing 114 is installed onto the drive shaft 120 and into the bearing housing 110.

The drive shaft 120 may have a first end 122 and a second end 124 and may be partially threaded. As shown in FIG. 4, the drive shaft 120 may have a plurality of distinct diameter regions. For example, the drive shaft 120 may have a first region 128 with a first diameter 129 corresponding to the threaded region, a second region 130 having a second diameter 131 with a smooth surface, and a third region 132 which may have a third diameter 133. The first diameter 129 may be greater than both the second diameter 131 and the third diameter 133. The first diameter 129 may be approximately 1 inch or within a range of 0.75 inches and 1.5 inches or within a range of 0.5 inches to 2.0 inches. The threaded portion (first region 128) may be ACME threads or other similar threads. Alternatively, the drive shaft 120 may have two distinct diameter regions or four distinct diameter regions.

The first end 122 may have a drive element 127 to allow a user to engage the drive shaft 120 with a rotating tool, such as a torque wrench 20 or similar device to rotate the drive shaft 120. As shown in FIG. 3, the drive element 127 may have a hexagonal shape to be engaged by a standard hexagonal socket. The standard hexagonal socket may be a 0.5 inches or larger. Preferably, the torque wrench 20 has a length of 18 inches or longer. A battery-operated drill-type apparatus or an air hammer attached to a pneumatic supply could be utilized as the rotating tool in lieu of the torque wrench 20, thereby engaging the drive shaft 120 and rotating the drive shaft 120 to move the drive shaft 120 up and down.

As discussed the drive shaft 120 may connect to the mounting flange 134. The mounting flange 134 may have a centrally located aperture 136 to connect the drive shaft 120. The mounting flange 134 may be connected to the drive shaft in a plurality of ways. For example, the aperture 136 may be threaded to directly engage the drive shaft 120, or alternatively as shown in FIG. 4, a nut 137 may be connected to the aperture 136 of the mounting flange 134 where the drive shaft 120 may connect to the mounting flange 134 with the nut 137 positioned between the mounting flange 134 and the drive shaft 120. The nut 137 may be integrally joined to the mounting flange 134 or some may be connected using an anti-rotation element to prevent the nut 137 from rotating in relation to the mounting flange 134 when the drive shaft 120 is rotated, such as a set screw. The mounting flange 134 may also have a plurality of mounting holes positioned around the perimeter to allow for easy connection to the plurality of standoffs 170. The mounting flange 134 may be releasably connected to the standoffs 170 or the drive shaft 120 to allow any repairs that may be required.

The plurality of standoffs 170 may be hollow tubes that connect at a first end to a mounting flange 134 and a second end of connected to an extractor 140. Each standoff 170 may have internal threads such that they may be releasably connected using a threaded fastener. Alternatively, the plurality of standoffs 170 may be integrally joined to the either the mounting flange 134 or extractor 140 or both.

Each standoff 170 may be approximately 7 inches long or within a range of 5 inches to 9 inches or within a range of 3 inches to 12 inches. Each of the standoffs 170 may be the same length, but depending on the shape of the either the mounting flange 134 or extractor 140, each of the standoffs 170 may have different lengths.

Figure 5:
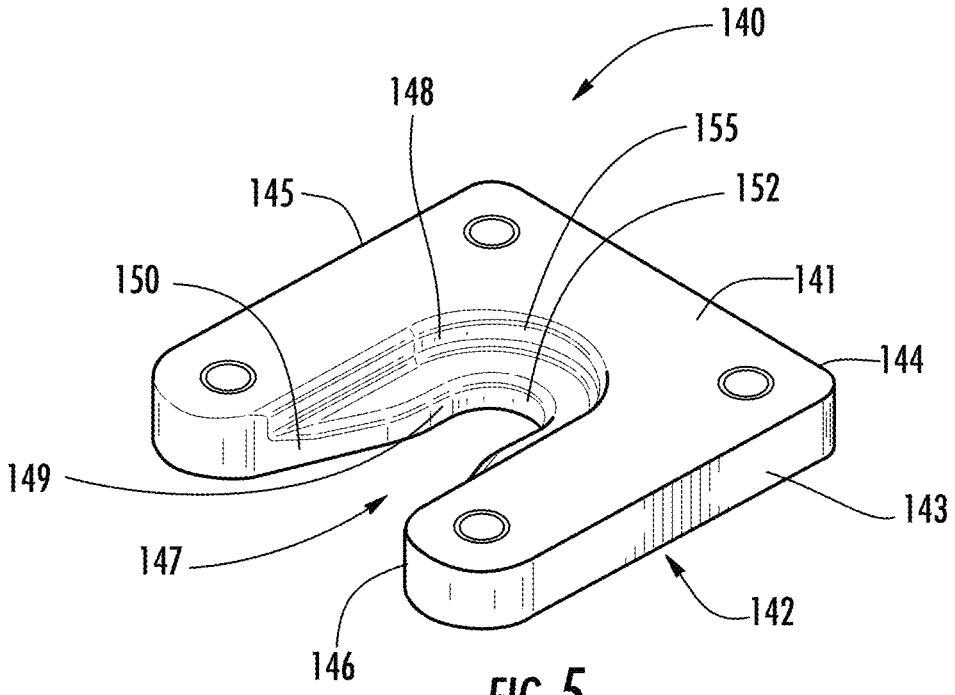
FIG. 5 illustrates a perspective view of an extractor from the example embodiment of the rail spike remover of FIG. 1 with other components removed.
Figure 6:
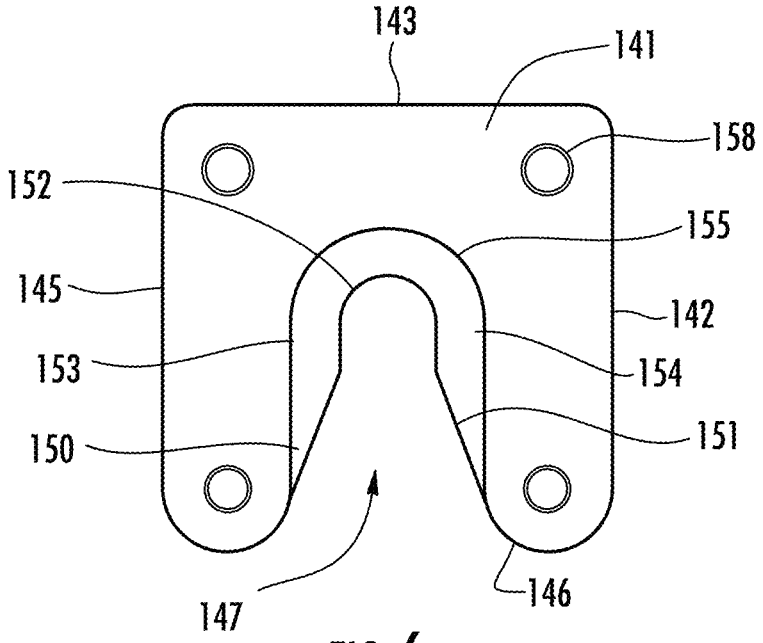
FIG. 6 illustrates a top view of the extractor of FIG. 5.

As discussed above, the plurality of standoffs 170 connect to an extractor 140. As shown in FIGS. 5 and 6, the extractor 140 may comprise a metallic plate with a top surface 141, a bottom surface 142, and a plurality of side surfaces 143, 144, 145, 146. The extractor 140 may further comprise an opening 147 through the top and bottom surface and extending through at least one side surface. The opening may further include an upper portion 148 and a lower portion 149. The lower portion 149 of the opening may have a plurality of tapered side walls 150, 151 and a first rounded rear wall 152. The plurality of tapered side walls 150, 151 may be vertically oriented and taper toward one another. The upper portion 148 of the opening may have vertically oriented side walls 153, 154, and a second rounded rear wall 155, wherein the width of the upper portion 148 is larger than the width of the lower portion 149. The first rounded rear wall 152 and the second rounded rear wall 155 may be concentric. The extractor 140 may have a plurality of holes 158 to releasably connect the extractor 140 to the plurality of standoffs 170.

The plurality of holes 158 may be positioned near the side surfaces 143, 144, 145, 146 of the extractor 140 and extend through the top surface 141 and bottom surface 142. The plurality of holes 158 may be threaded or clearance holes for a threaded fastener. Alternatively, as discussed above, the extractor 140 may be integrally joined to the standoffs 170. Additionally, as discussed above, the extractor 140 may be connected directly to the drive shaft 120.

Figure 7:
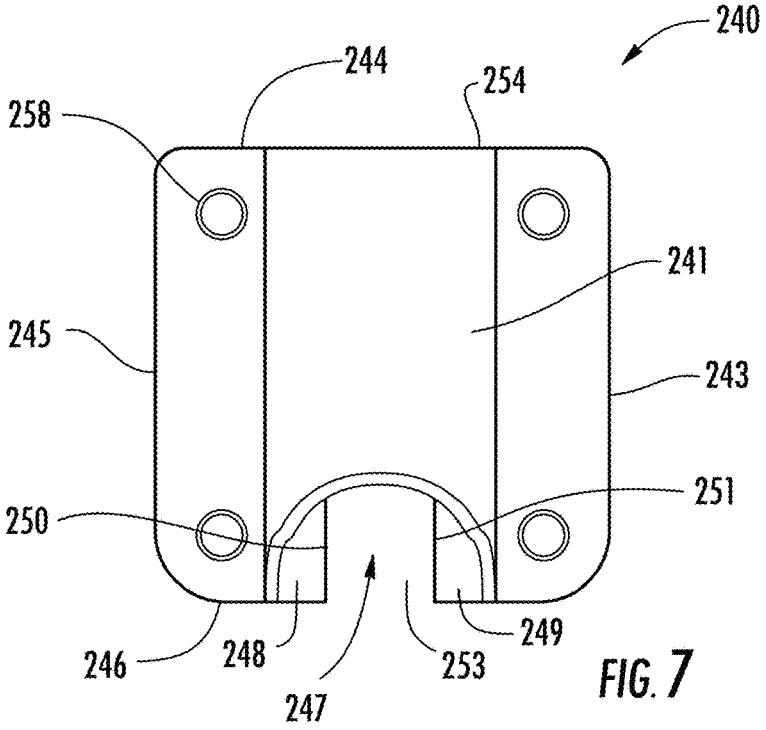
FIG. 7 illustrates a top view of an alternate embodiment of the extractor of the rail spike remover of FIG. 1.
Figure 8:
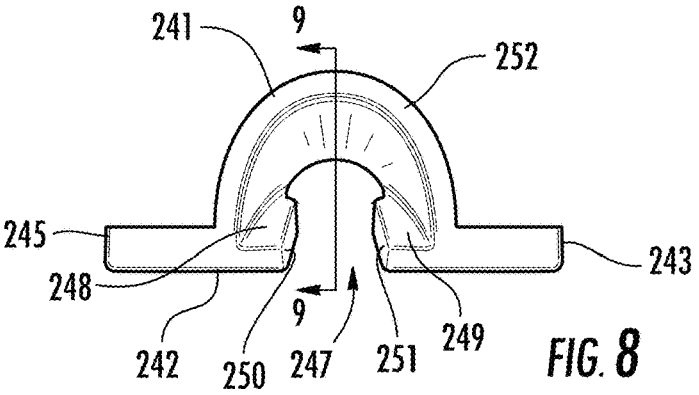
FIG. 8 illustrates a front view of an extractor tooth from the extractor of FIG. 7.
Figure 9:
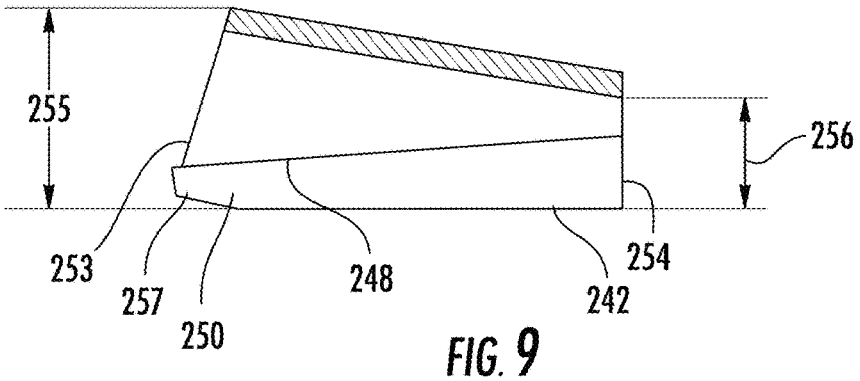
FIG. 9 illustrates a cross-sectional view of the extractor tooth of FIG. 7.

FIGS. 7-9 show an alternate embodiment for the extractor 140. For the embodiment of FIGS. 7-9, the features of the extractor 240 are referred to using similar reference numerals under the "2XX" series of reference numerals, rather than "1XX" as used in the embodiment of FIGS. 5 and 6. Accordingly, certain features of the extractor 240 that were already described above with respect to the extractor 140 of FIGS. 5-6 may be described in lesser detail, or may not be described at all.

The extractor 240 may have the similar exterior shape as extractor 140 to fit within the main column 102 with a top surface 241, a bottom surface 242, and a plurality of side surfaces 243, 244, 245, 246. An opening 247 may extend through at least two side surfaces and the bottom surface 242. The opening 247 may include a first guide rail 248, a second guide rail 249, a first side wall 250 adjacent the first guide rail, a second side wall 251 adjacent the second guide rail, and an upper surface 252 connecting the first guide rail 248 to the second guide rail 249. The upper surface 252 of the opening may be rounded and exposed to the exterior. The opening 247 may have a first end 253 and a second end 254, wherein a first height 255 at the first end 253 may be defined as a distance perpendicular from the bottom surface 242 of the extractor 240 to the furthest extent of the upper surface 252 and the second end 254 may have a second height 256 defined from the bottom surface 242 to the furthest extent of the second end 254 of the upper surface 252. The bottom surface 242 may further include an angled region 257, such that the angled region 257 angles upward toward the first end 253 of the opening 247.

Additionally, the top surfaces of the first guide rail 248 and the second guide rail 249 may be coplanar surfaces. The first guide rail 248 may have a height at the first end 253 of the opening 247 defined as a perpendicular distance from the bottom surface 242 of the extractor 240 to the furthest extent of the first end 253 of the first guide rail 248. Similarly, the second end 254 may have a second height defined as a perpendicular distance from the bottom surface 242 to the furthest extent of the second end 254 of the first guide rail 248, wherein the first height is smaller than the second height. The guide rails 248, 249 may be linear surfaces and angle in a direction away from the bottom surface 242. Thus, the opening 247 may be larger at the first end 253 than at the second end 254.

The first side wall 250 adjacent the first guide rail 248 and the second side wall 251 adjacent the second guide rail 249 are parallel. Alternatively, the first side wall 250 adjacent the first guide rail 248 and the second side wall 251 adjacent the second guide rail 249 are angled toward one another. Also, similar to the extractor 140, the extractor 240 may have a plurality of holes 258 to connect the extractor 240 to the plurality of standoffs 170.

The various components for the railroad spike remover 100, such as the main column 102, the bearing housing 110, the drive shaft 120, the mounting flange 134, the plurality of standoffs 170, and the extractor 140, 240 may be made of a metallic material, preferably a steel alloy. Alternatively, the components may be made of other metallic materials such as iron, aluminum, an aluminum alloy, titanium, or a titanium alloy.

The railroad spike remover 100 may be portable for a single user to move and operate. Thus, the railroad spike remover 100 may have a weight of less than 50 pounds. In other embodiments of this invention, the railroad spike remover 100 and 500 may have a weight of less than 30 pounds.

To operate the railroad spike remover 100, a user may position the railroad spike remover 100 near a railroad spike 10 and then slide the opening 147 of the extractor 140 onto the top of the railroad spike 10 such that the railroad spike 10 is secured in extractor 140. The user may then position the railroad spike remover 100 over the railroad spike 10. The user then engages the drive element 127 with the torque wrench 20 and rotates the drive shaft 120 to raise the mounting flange 134 and the extractor 140. As the drive shaft 120 is turned, the extractor 140, along with the railroad spike 10, raises into the main column 102 until the railroad spike 10 is released from the rail tie. Then, the user may reverse the drive shaft 120 to lower the mounting flange 134 and the extractor 140 to allow the railroad spike remover 100 to be ready to remove another railroad spike 10. As was discussed above, a battery-operated drill-type apparatus or an air hammer attached to a pneumatic supply could be utilized in lieu of the torque wrench, thereby engaging the drive shaft 120 and rotating the drive shaft to move the drive shaft 120 up and down.

Figure 10:
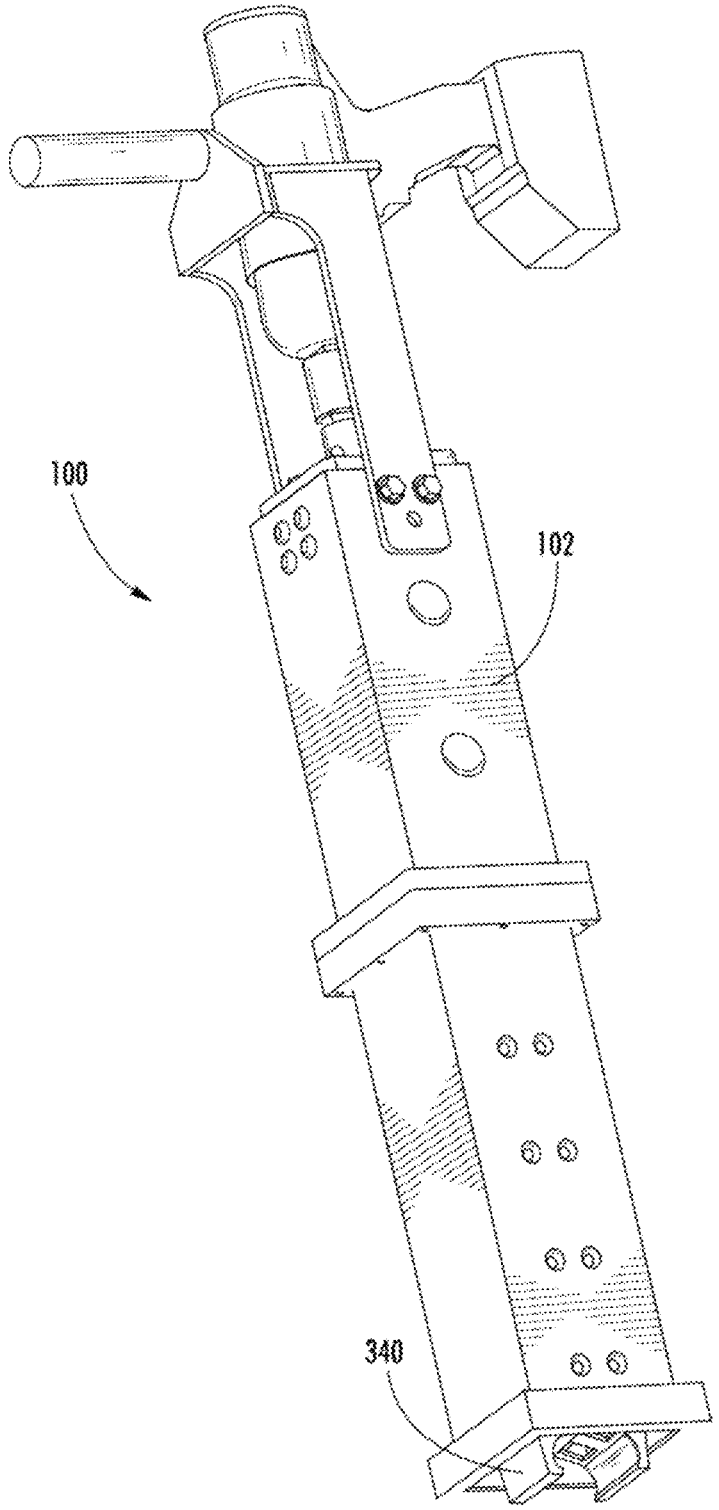
FIG. 10 illustrates a side perspective view of an alternate embodiment of the extractor of the rail spike remover of FIG. 1.
Figure 11:
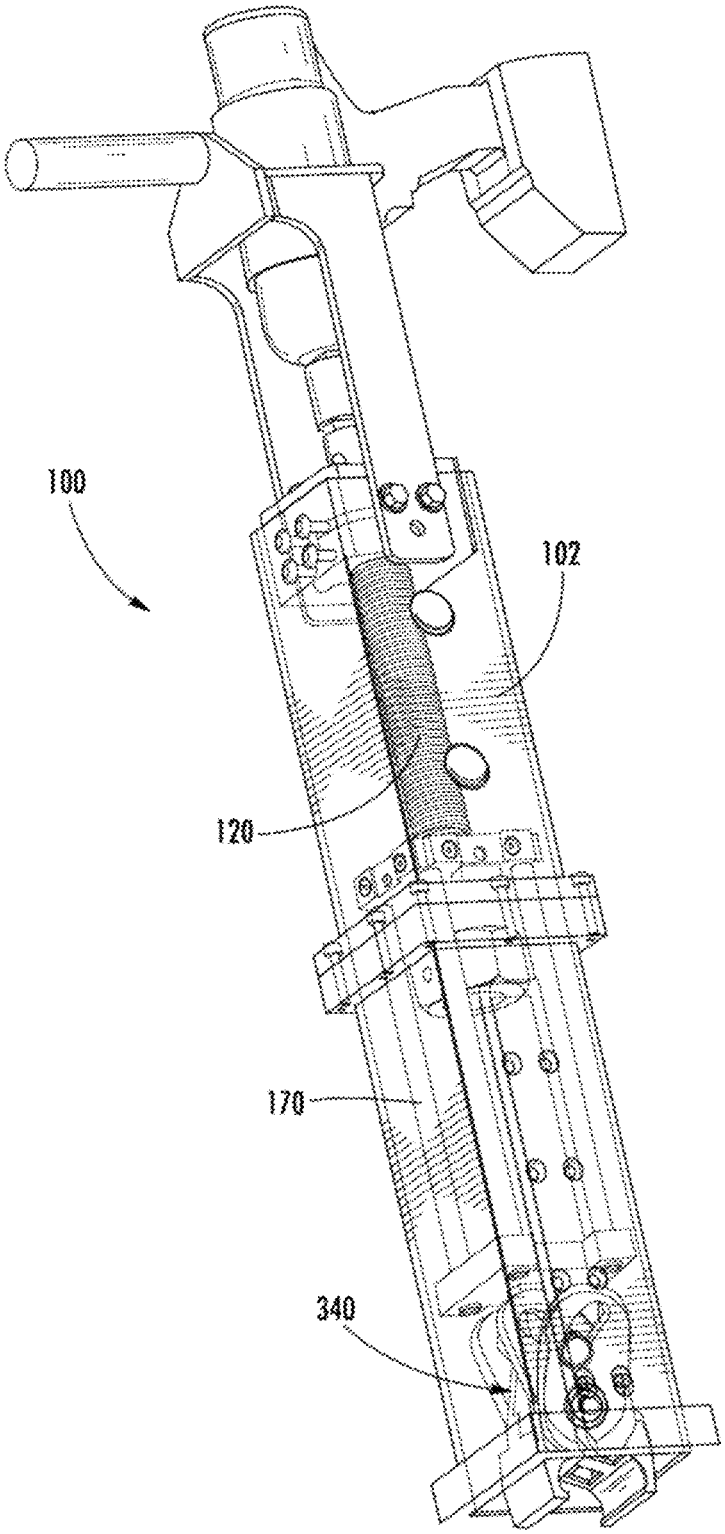
FIG. 11 illustrates an internal side perspective view of the extractor and rail spike remover of FIG. 10.
Figure 12:
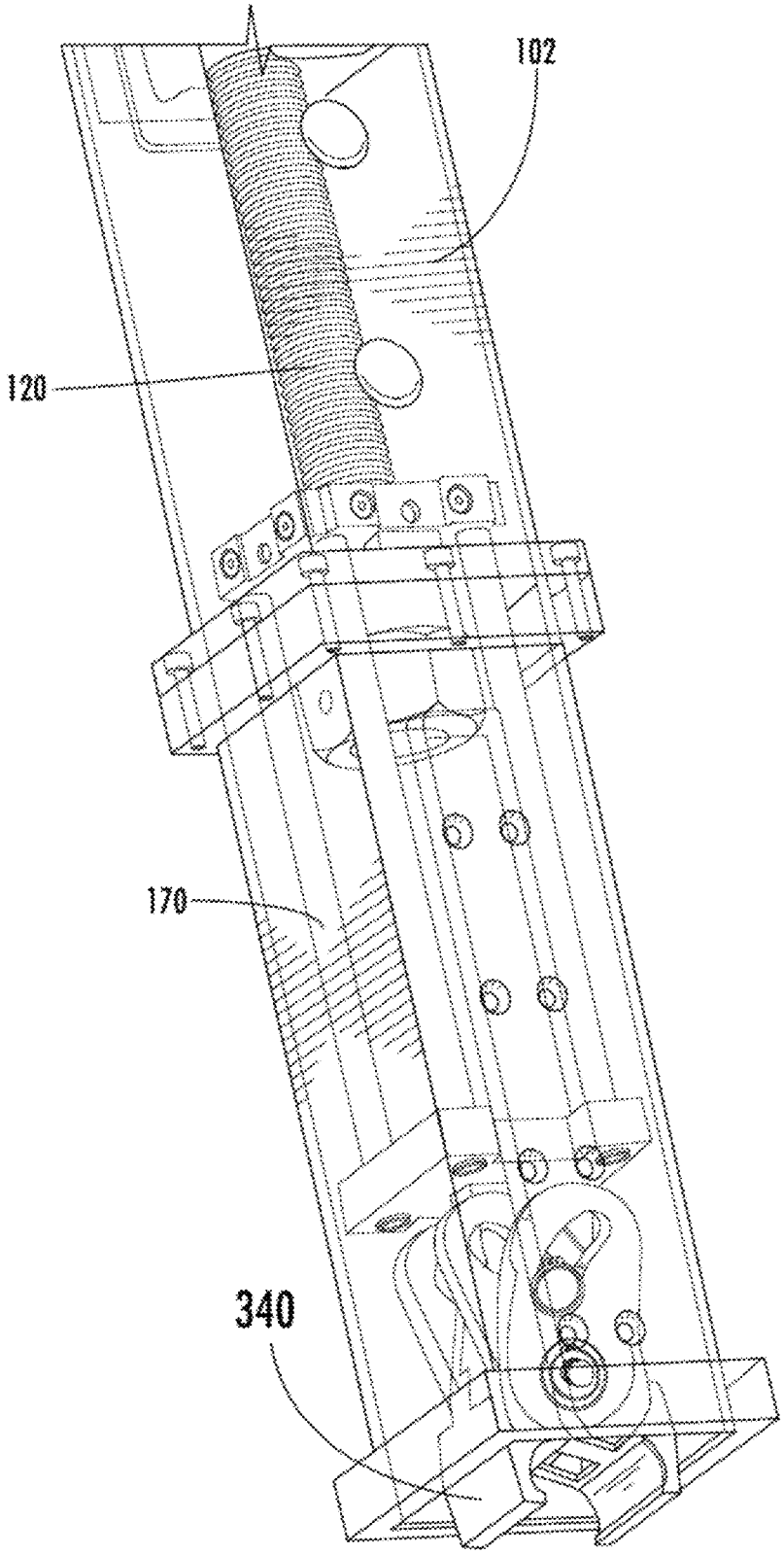
FIG. 12 illustrates a close-up view of a bottom portion of the extractor and rail spike remover of FIG. 10.
Figure 13:
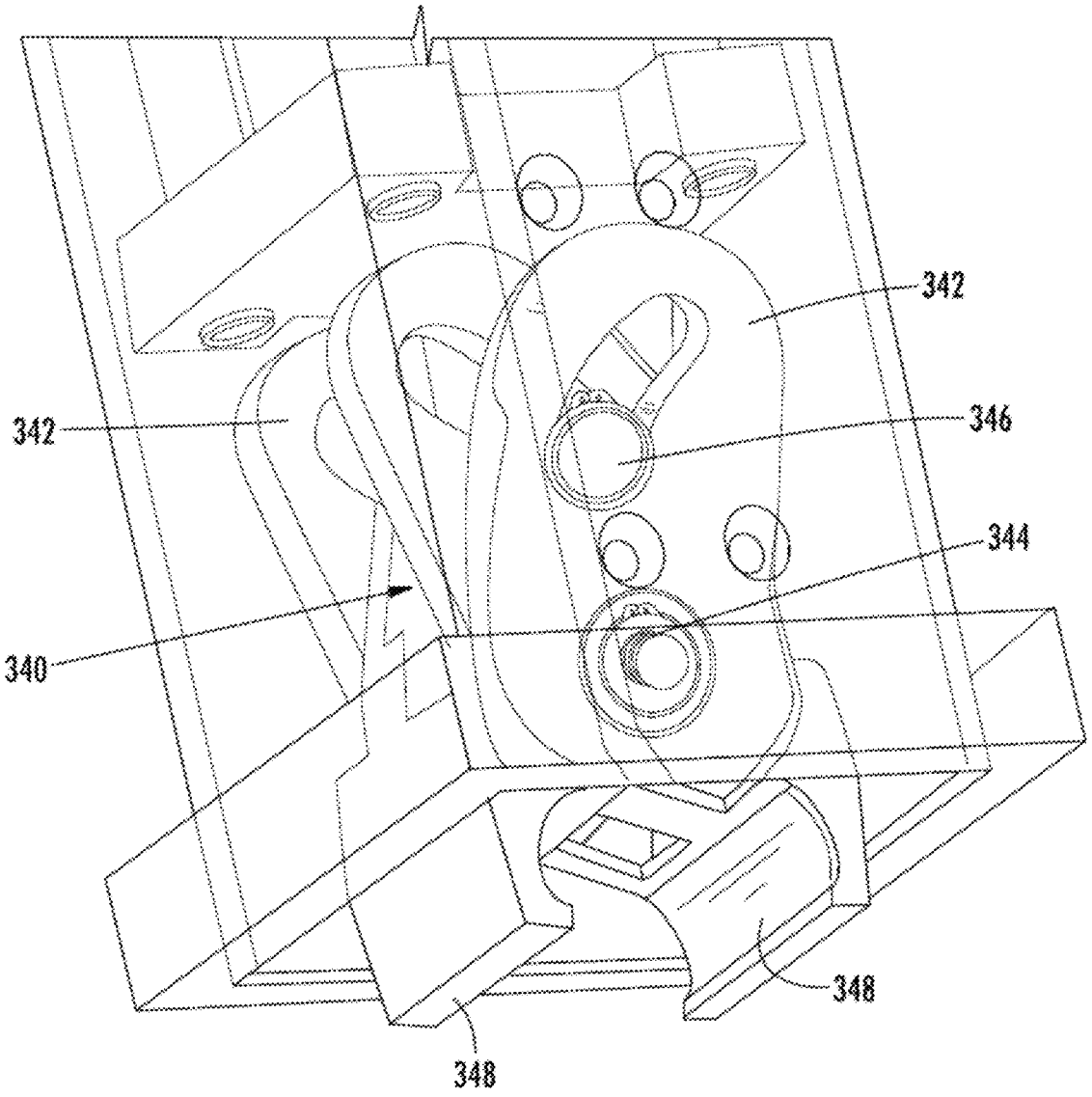
FIG. 13 illustrates a close-up view of the extractor and rail spike remover of FIG. 10.
Figure 14:
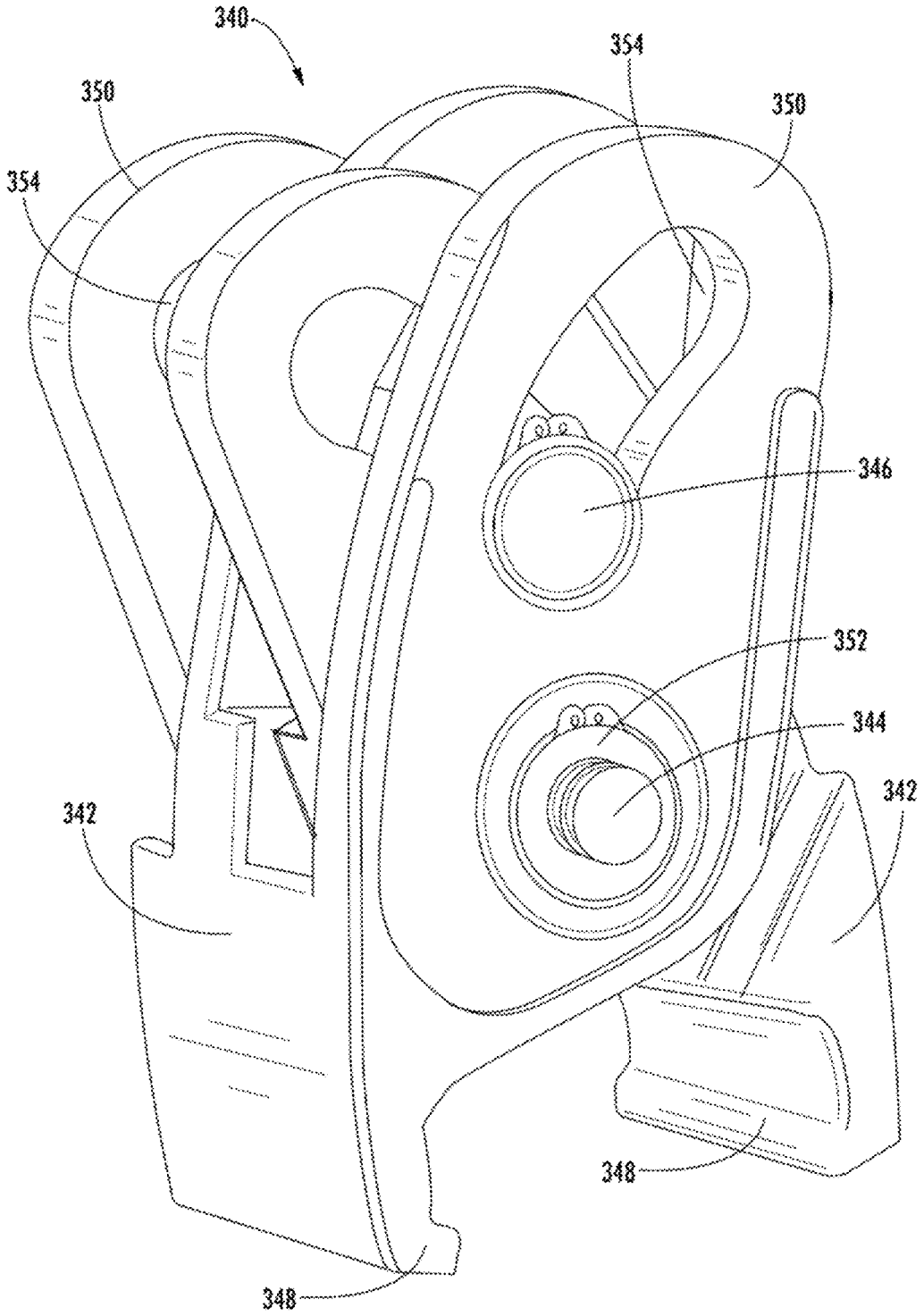
FIG. 14 illustrates a side perspective view of the extractor of the rail spike remover of FIG. 10.

FIGS. 10-14 show an alternate embodiment for the extractor 140, 240. For the embodiment of FIGS. 10-14, in the place of the extractor 140, 240, the railroad spike remover 100 may include an extractor 340 with moving jaws 342 that are frictionally delayed. The features of the extractor 340 are referred to using similar reference numerals under the "3XX" series of reference numerals, rather than "1XX" as used in the embodiment of FIGS. 5 and 6. Accordingly, certain features of the extractor 340 that were already described above with respect to the extractor 140 of FIGS. 5-6 may be described in lesser detail, or may not be described at all. The extractor 340 may be used with similar features of the railroad spike remover 100 already described above. 7 FIG. 10 illustrates a side perspective view of an alternate embodiment of the extractor of the rail spike remover of FIG. 1. FIG. 11 illustrates an internal side perspective view of the extractor and rail spike remover of FIG. 10. FIG. 12 illustrates a close-up view of a bottom portion of the extractor and rail spike remover of FIG. 10. FIG. 13 illustrates a close-up view of the extractor and rail spike remover of FIG. 10. FIG. 14 illustrates a side perspective view of the extractor of the rail spike remover of FIG. 10.

Figure 15A:
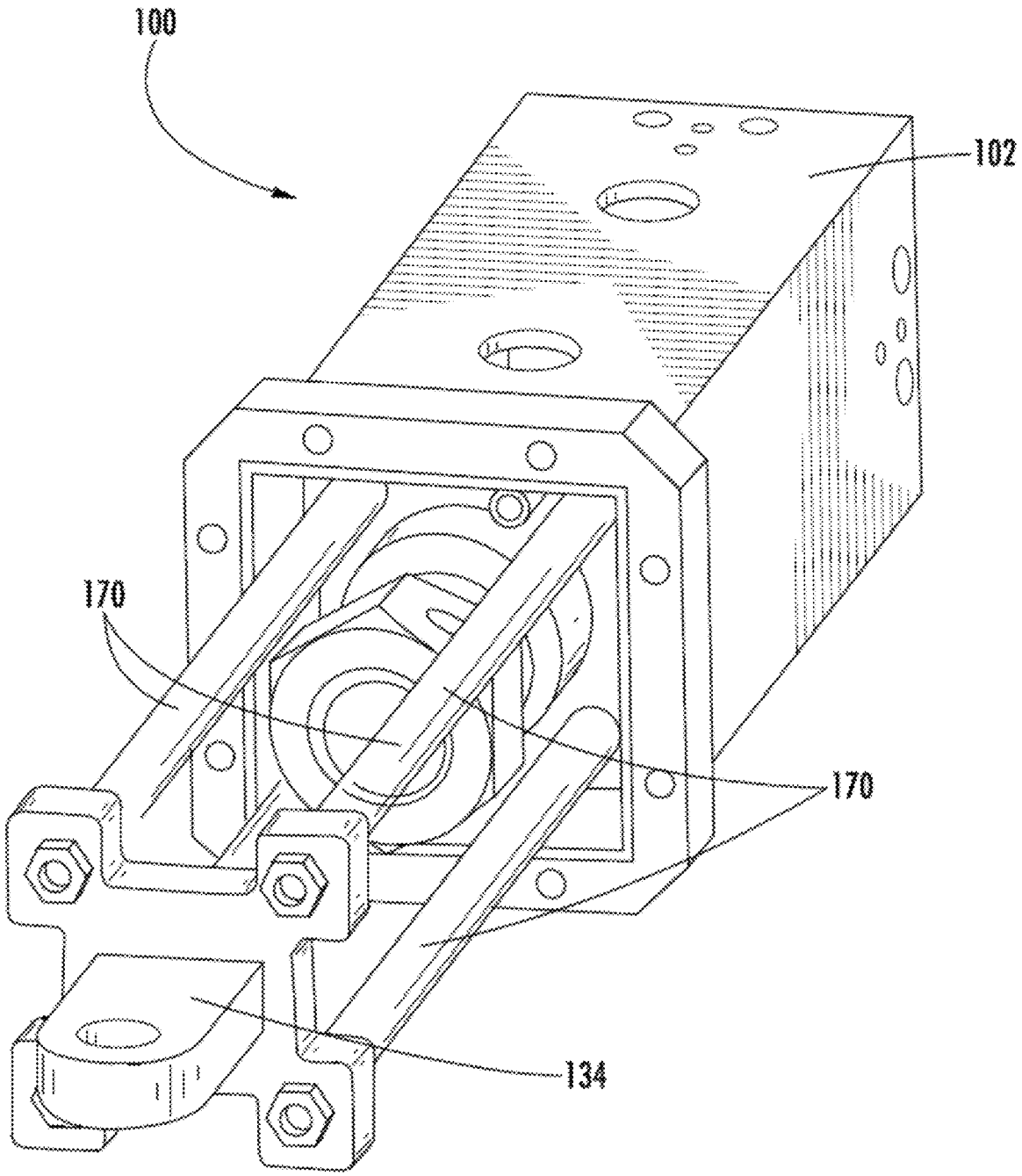
FIGS. 15A-15D illustrate the interchangeability of the extractors 140 and 340 for the railroad spike remover 100.

As discussed above, the plurality of standoffs 170 connect to an extractor 340. As shown in FIGS. 10-14, the extractor 340 may comprise a claw assembly extractor. Generally, the claw assembly extractor 340 may be designed to open, close, and grab with the drive shaft 120 movement the railroad spike at a force as high as 19,000 pounds. The claw assembly extractor 340 may include a pair of jaws 342 that are pivotally connected to each other by a pivoting pin 344 and a rotating pin 346. The lower ends 348 of the jaws 342 are configured to contact and grab the railroad spike 10. The upper members 350 of the jaws 342 are pivotally connected to the mounting flange 134 with the rotating pin 346 or the pivoting pin 344 as illustrated in FIG. 15A. When the drive shaft 120 is pulled upward, the jaws 342 move towards a grabbing position to grab onto the railroad spike 10.

The extractor 340 and claw assembly extractor includes the two jaws 342, a pivoting pin 344, the two upper members 350, spacer caps, a rotating pin 346, and a friction assembly. The friction assembly generally includes a spring and friction caps. The jaws 342 and upper members 350 form a moveable parallelogram assembly. The jaws 342 each have a pivot hole 352 which the pivot pin 344 is located in. The jaws 342 also each have a rotating section 354 which the rotating pin 346 is located in. The upper members 350 of the jaws 342 are pivotally connected to the jaws 342 by their rotating sections 354 and the rotating pins 346. The upper members 350 of the jaws 342 may be also pivotally connected to the mounting flange 134 and drive shaft 120 by the pivoting pin 346.

The friction assembly functions for keeping the jaws 342 in an open position as the jaws 342 are moved from the up position to the home position after a spike 10 has been pulled. Initially, a user places the railroad spike remover 100 over the spike 10 with the jaws 342 in the open position. When the user begins movement of the railroad spike remover 100, the drive shaft 120 is moved upward, pulling the upper members 350 upward and rotated pulling the upper members 350 of the jaws 342 towards each other. The friction assembly keeps the centers of the jaws 342 fixed relative to the main column 102 such that the jaws 342 only initially rotate and do not translate relative to the main column 102. Thus, the lower ends 348 of the jaws 342 are able to rotate under the head of the spike 10. Then the jaws 342 are stopped by the spike 10 from further rotation, the upward movement of the drive shaft 120 overcomes the frictional forces of the friction assembly and the jaws 342 translate upward along the interior of the main column 102 pulling the spike 10 with it. When the user releases the movement of the railroad spike remover 100, the drive shaft 120 is moved downward back towards its home position. The friction assembly initially holds the center of the jaws 342 fixed relative to the main column 102 such that the jaws 342 only initially rotate and translate to move the jaws 342 to an open position. As the jaws 342 are opened, the spike 10 is able to be released. The jaws 342 stop rotating and start translating down the main column 102 when the back surfaces of the jaws 342 lower ends contact the opposite interior sides of the main column 102. The lower ends 348 of the jaws 342 substantially block an area between the main column 102 and the back surfaces to prevent the spike 10 from entering this area. After the jaws 342 open the downward movement of the drive shaft moves the jaws 342 downward back to their home position while maintaining the jaws 342 in their open position along this home returning movement.

The claw assembly extractor and the jaws 342 includes a frictionally-delayed movement that includes pivoting claws 348 with arms or upper members 350 that frictionally contact each other and/or the main column 102 when opening and closing the jaws 342. The frictionally-delayed moving jaws functions as a means for keeping the jaws in an open position as the jaws 342 are moved from the up position to the home positions after a spike 10 has been pulled.

Figure 15B:
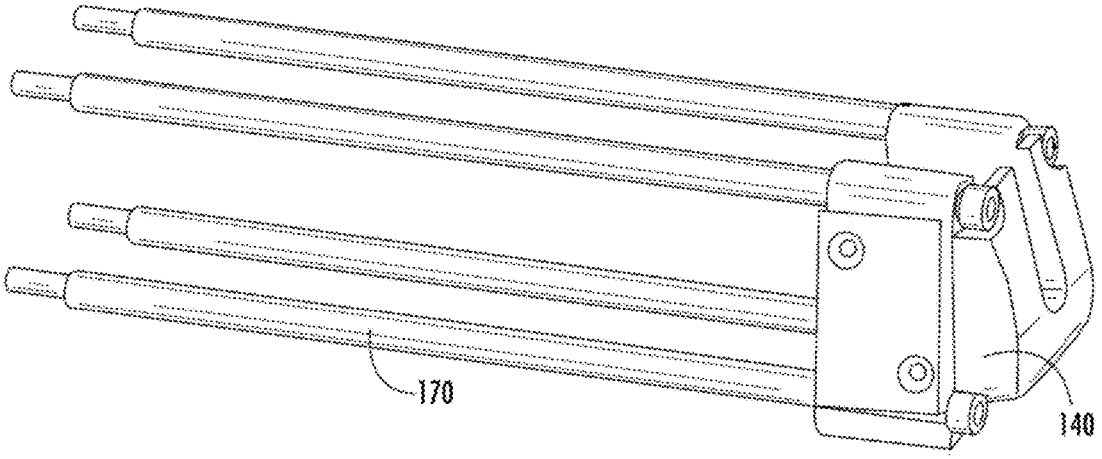
Figure 15C:
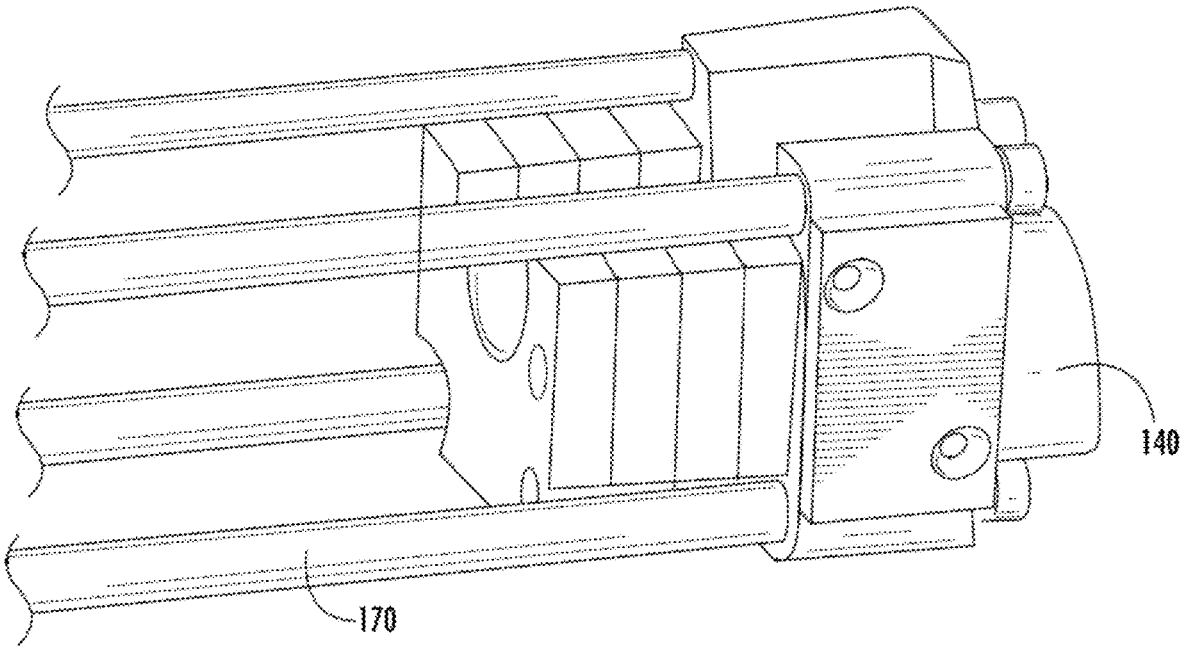
Figure 15D:
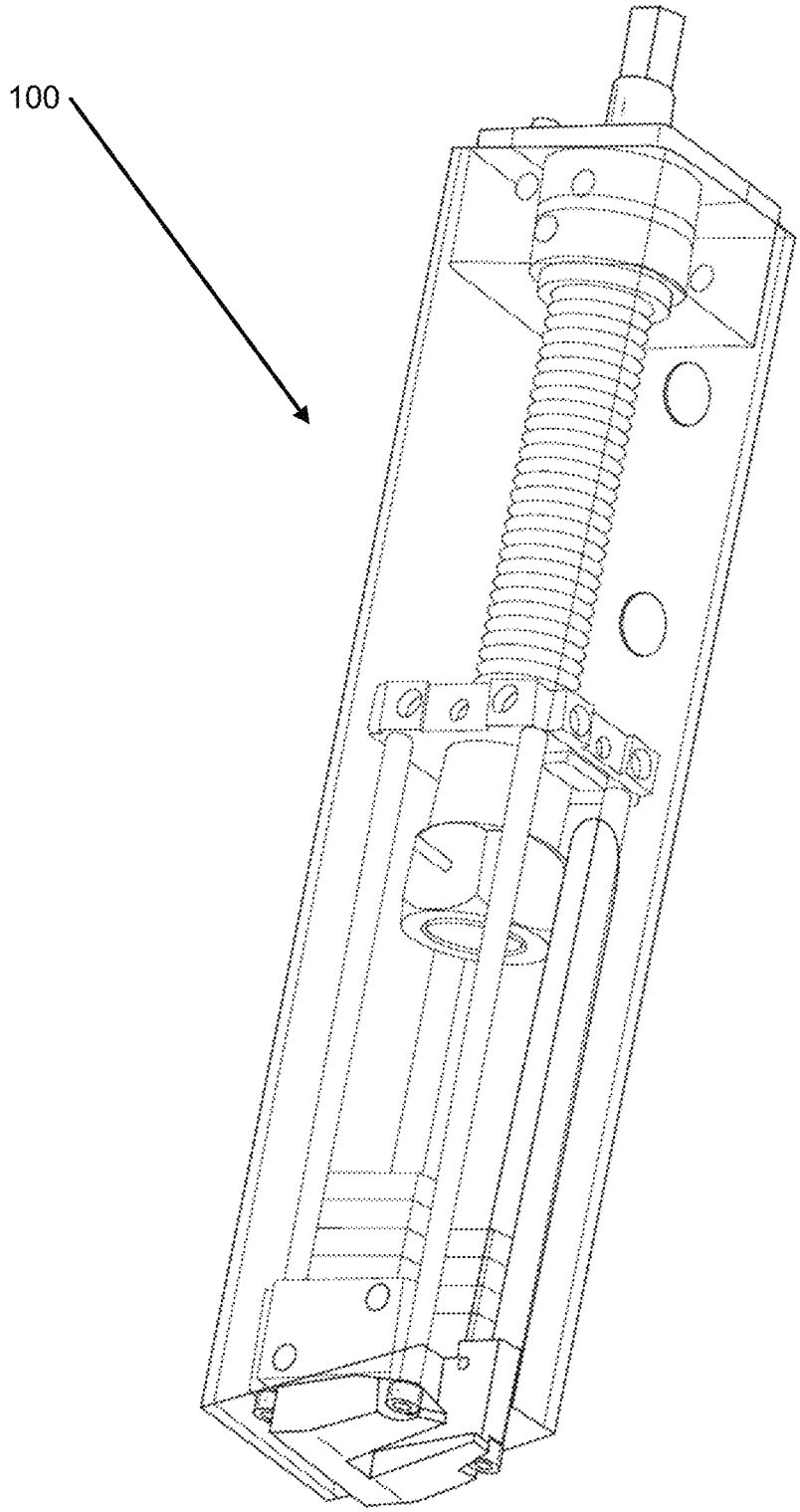

Additionally, FIGS. 15A-15D illustrate the interchangeability of the extractors 140 and 340 for the railroad spike remover 100. FIG. 15A illustrates fastening the mounting flange 134 to the top end of the main column 104 and the bearing housing 110 with the bolts and the standoffs 170. FIG. 15B illustrates sliding the standoffs 170 (or long bolts) into the extractor 140 (or claw) and then sliding the sleeves onto the standoffs 170 (or long bolts). FIG. 15C illustrates the use of spacers installed onto the extractor 140 (or claw) as needed, which will adjust the stroke of the railroad spike remover 100 from 4.5 to 6.5 inches. FIG. 15D illustrates sliding the extractor assembly (or claw assembly) into the main column 102 and tightening the four standoffs 170 (or long bolts) into the mounting flange 134.

Figure 16A:
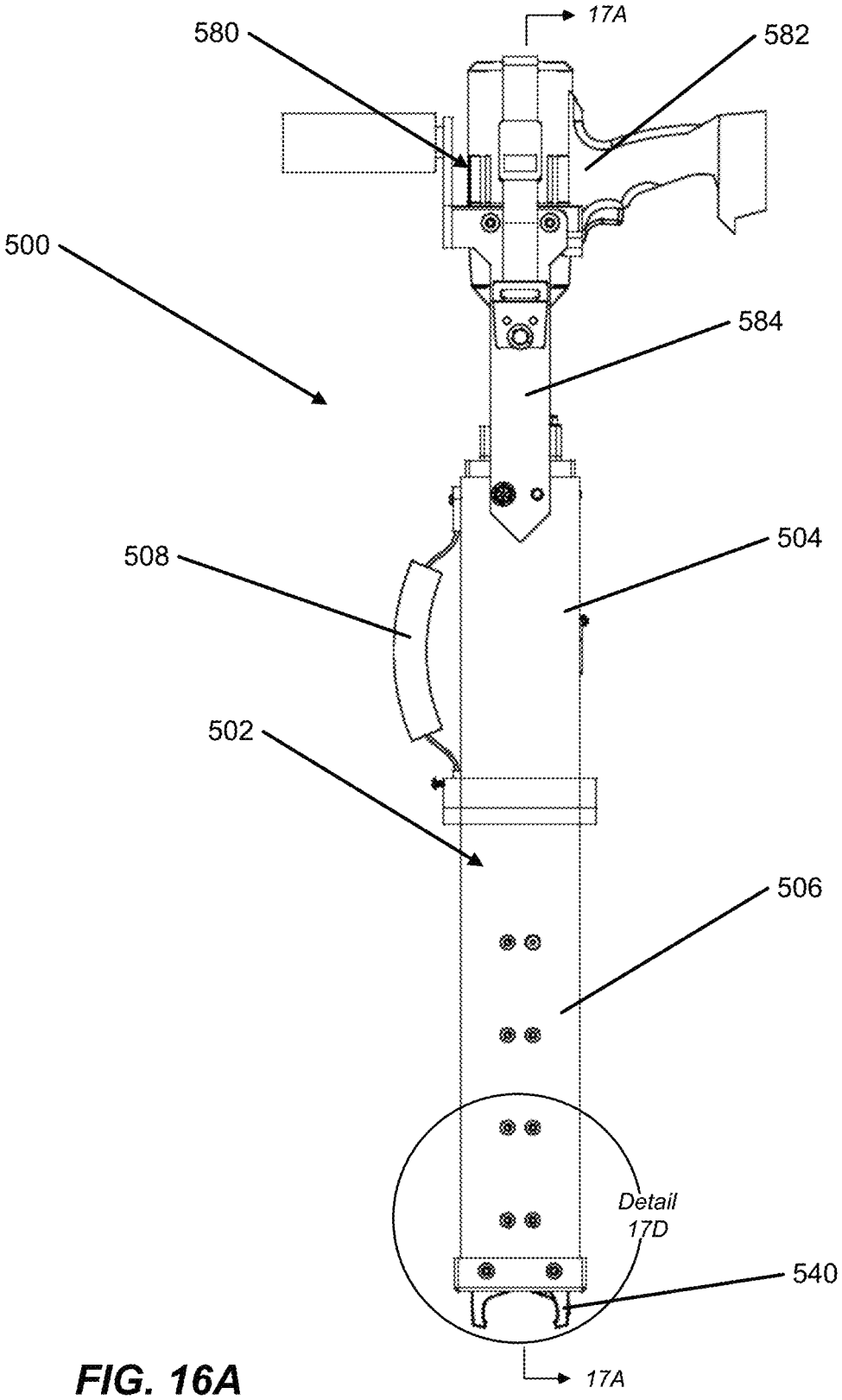
FIGS. 16A and 16B illustrate perspective views of an alternate embodiment of the rail spike remover of FIGS. 1 and 10.
Figure 16B:
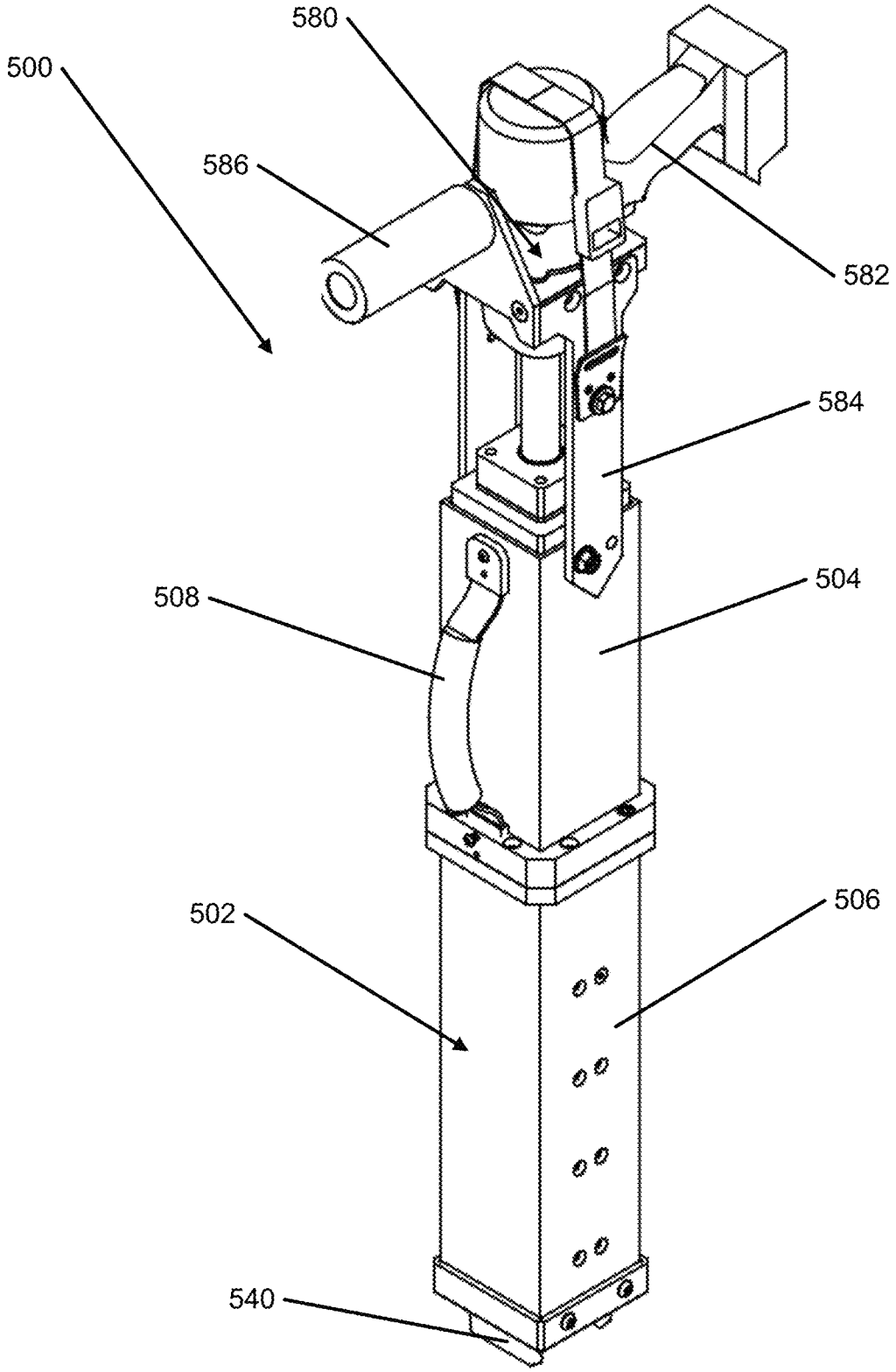
Figure 20A:
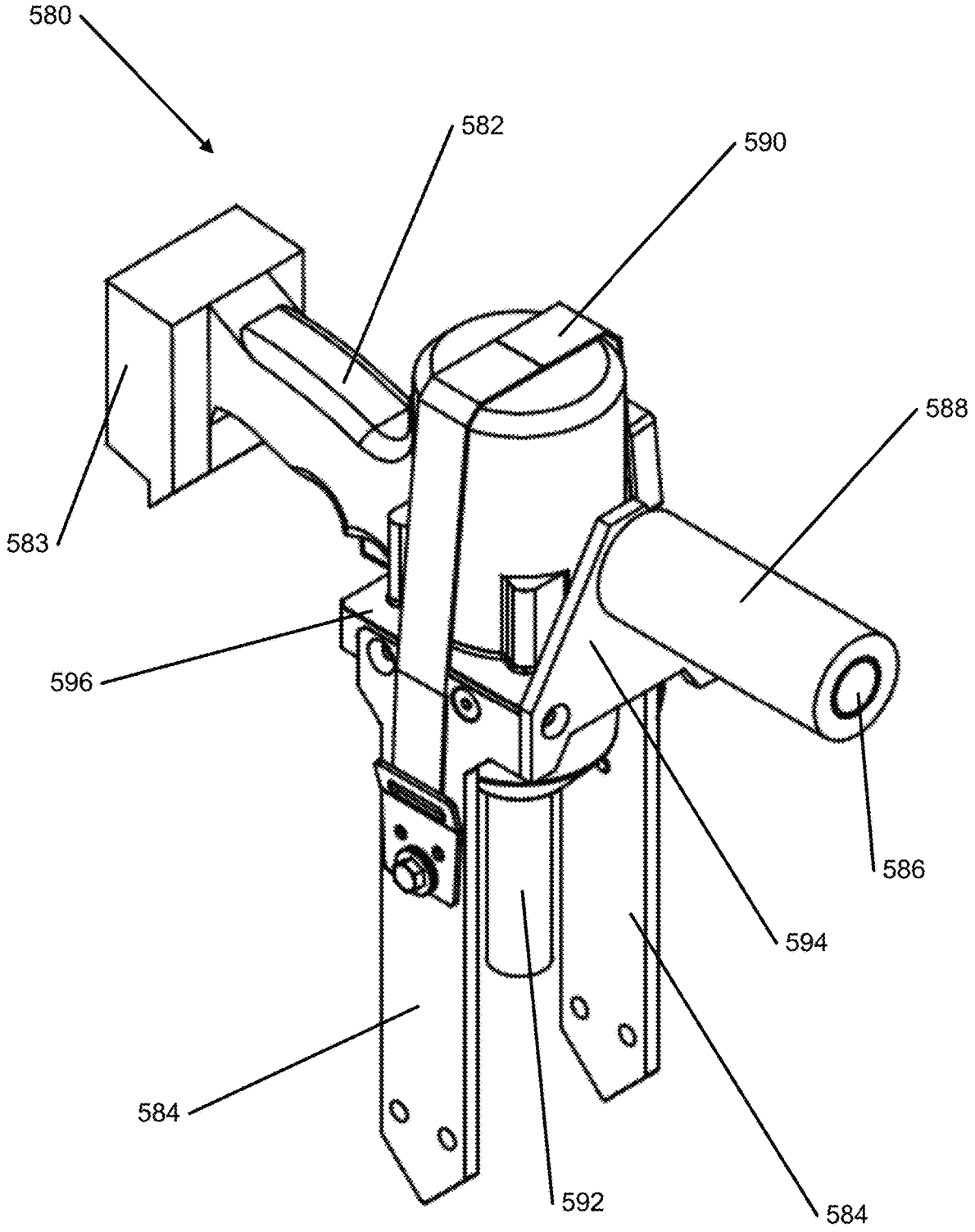
FIGS. 20A-20C illustrate perspective views of a T-handle assembly of the rail spike remover of FIGS. 16A and 16B.
Figure 20B:
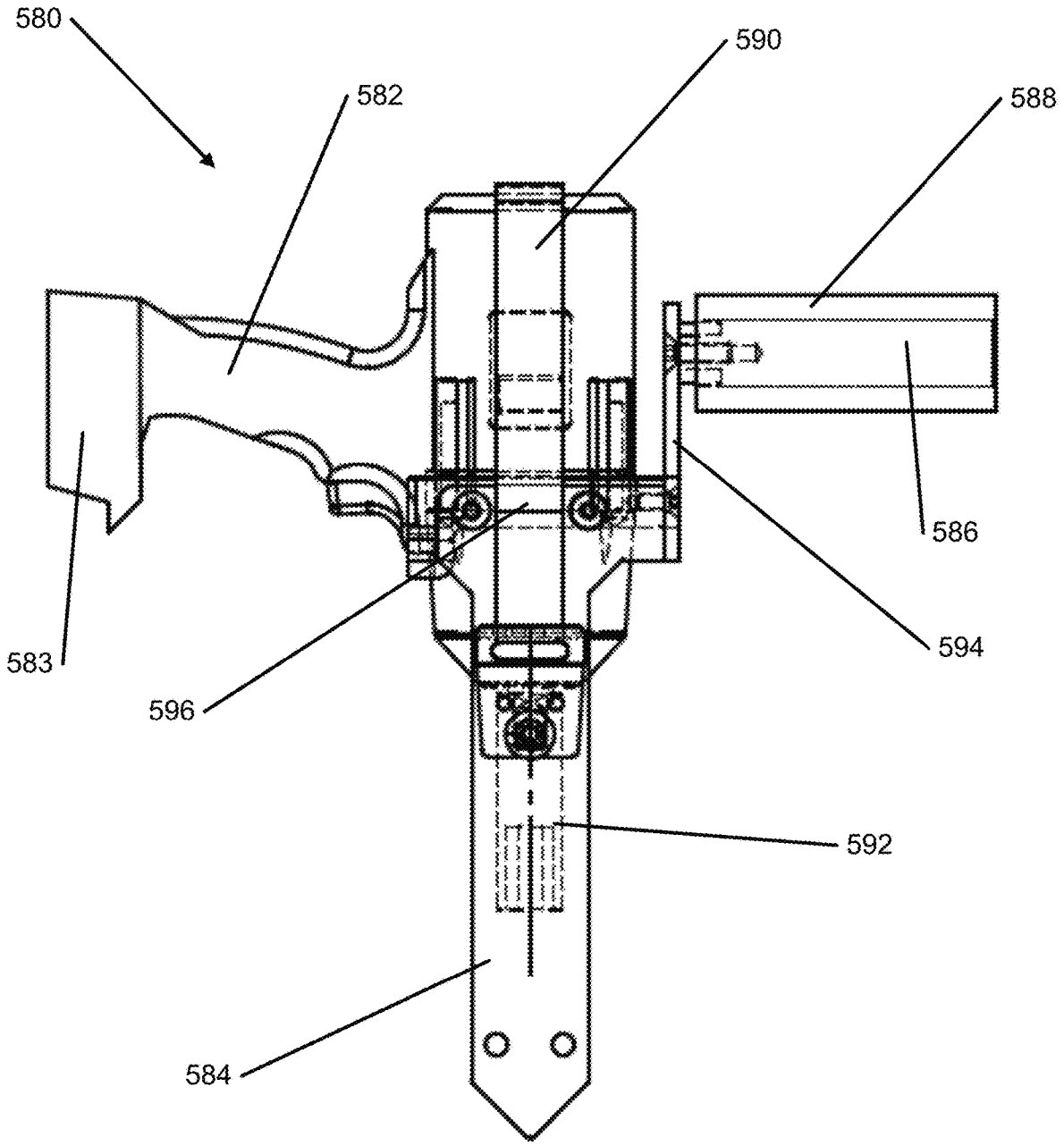
Figure 20C:
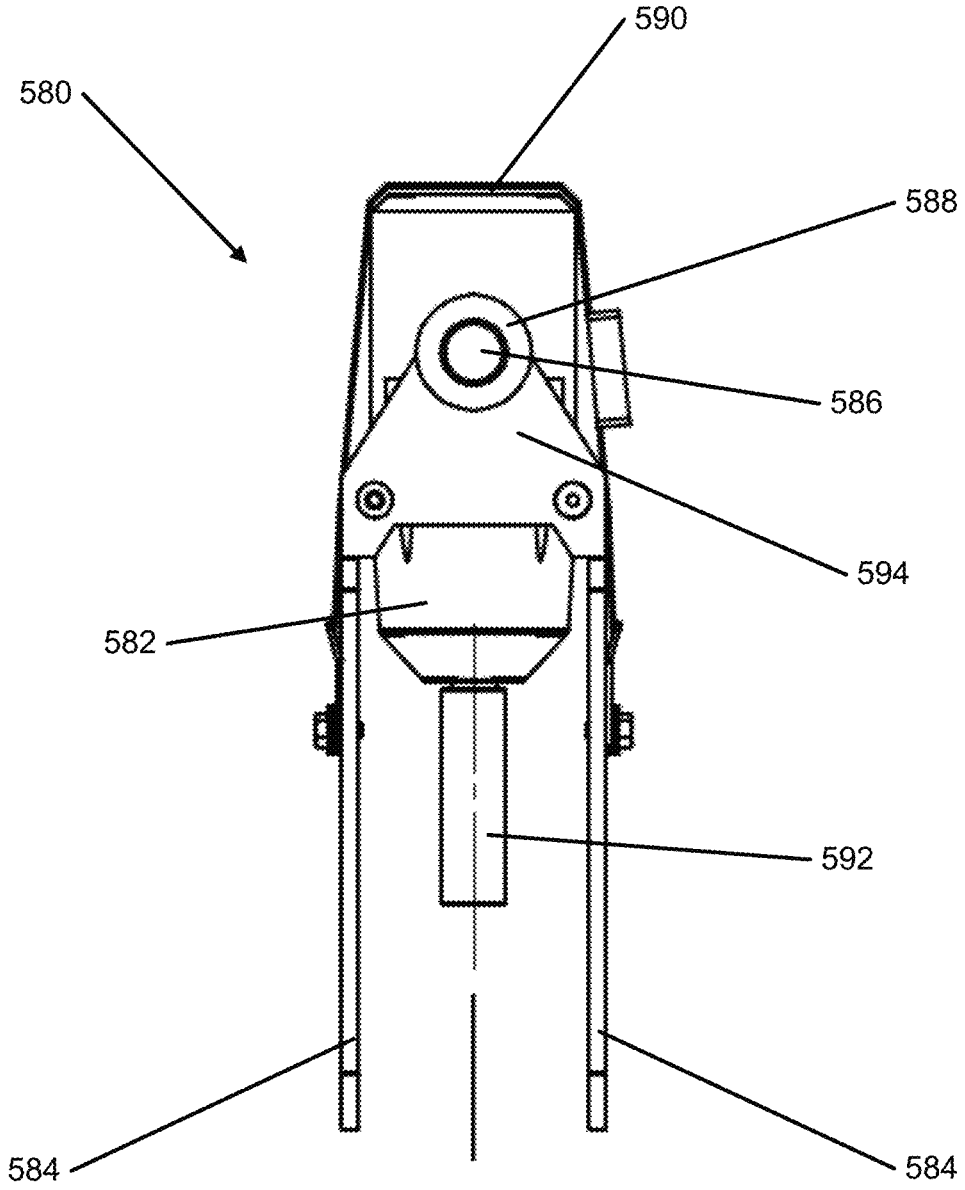

FIGS. 16A-20C show an alternate embodiment for a rail spike remover 500. The features of the rail spike remover 500 are referred to using similar reference numerals under the "5XX" series of reference numerals, rather than "1XX" or "3XX" as used in the embodiments of FIGS. 1 and 10. Accordingly, certain features of the rail spike remover 500 that were already described above with respect to the rail spike remover 100 of FIGS. 1-9 or the rail spike remover 300 of FIGS. 10-15D may be described in lesser detail, or may not be described at all. The rail spike remover 500 may be used with similar features of the railroad spike remover 100, 300 already described above. FIGS. 16A and 16B illustrate perspective views of an alternate embodiment of the rail spike remover of FIGS. 1 and 10. FIG. 17A illustrates a cross-sectional view along A-A of the rail spike remover of FIGS. 16A and 16B. FIG. 17B illustrates a cross-sectional view of detail B of the rail spike remover of FIGS. 16A and 16B. FIG. 17C illustrates a cross-sectional view of detail C of the rail spike remover of FIGS. 16A and 16B. FIG. 17D illustrates a cross-sectional view of detail D of the rail spike remover of FIGS. 16A and 16B. FIGS. 18A-18C illustrate perspective views of an upper housing of the rail spike remover of FIGS. 16A and 16B. FIGS. 19A and 19B illustrate perspective views of a lower housing assembly of the rail spike remover of FIGS. 16A and 16B. FIGS. 20A-20C illustrate perspective views of a T-handle assembly of the rail spike remover of FIGS. 16A and 16B.

The railroad spike remover 500 may comprise a main housing 502, a bearing housing 510, a plurality of standoffs 570, a mounting flange 534, an extractor 540, and a drive shaft 520 attached to a T-handle assembly 580 with a battery-operated drill-type tool 582. The main housing 502 may have an upper housing 504 and a lower assembly housing 506. The bearing housing 510 may be connected to the upper housing 504 and have an opening 512 for inserting the drive shaft 520. The drive shaft 520 may also extend through one or more bearings 514 secured in the bearing housing 510 by a cap plate 516.

Figure 17A:
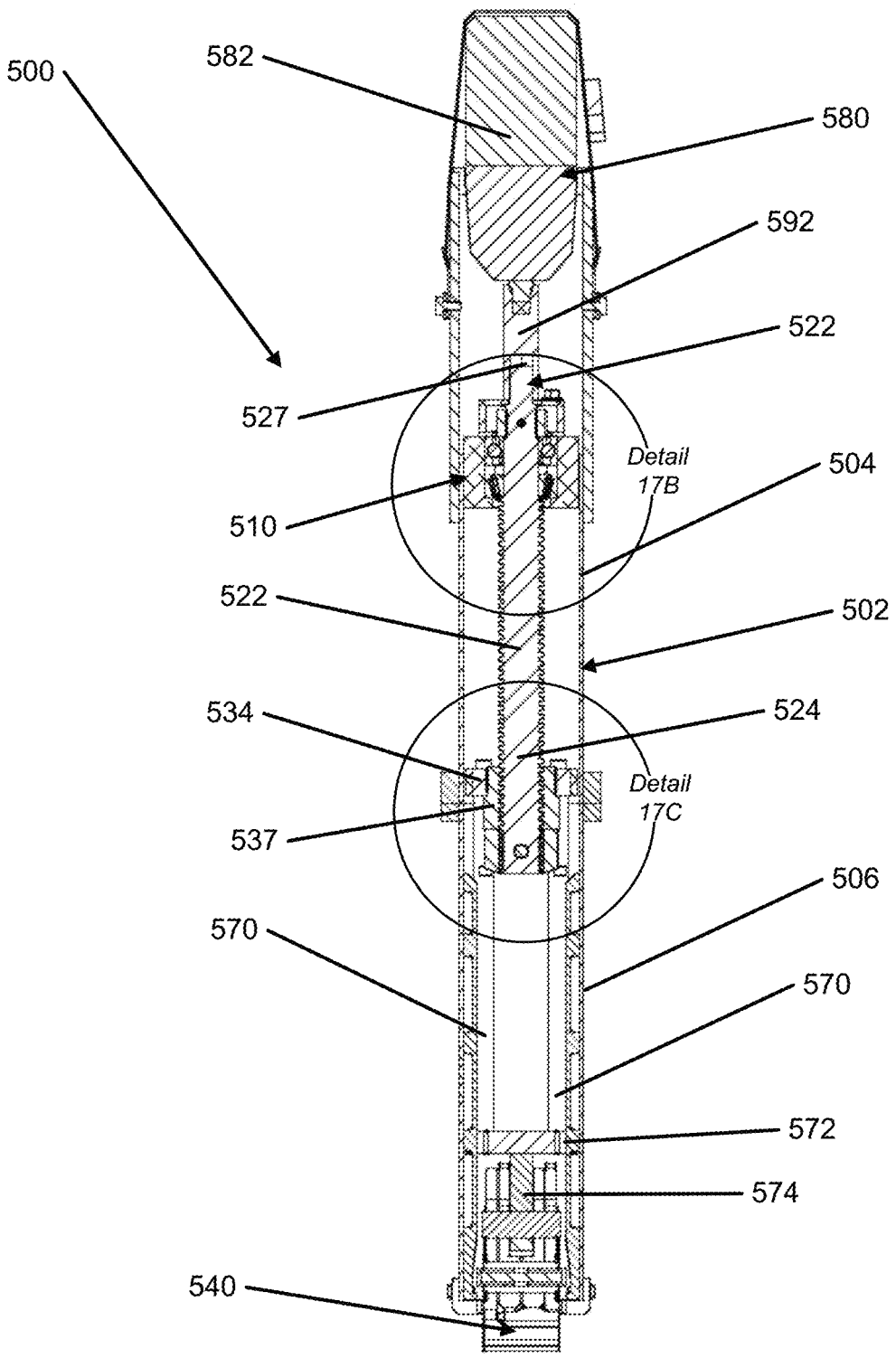
FIG. 17A illustrates a cross-sectional view along A-A of the rail spike remover of FIGS. 16A and 16B.
Figure 17B:
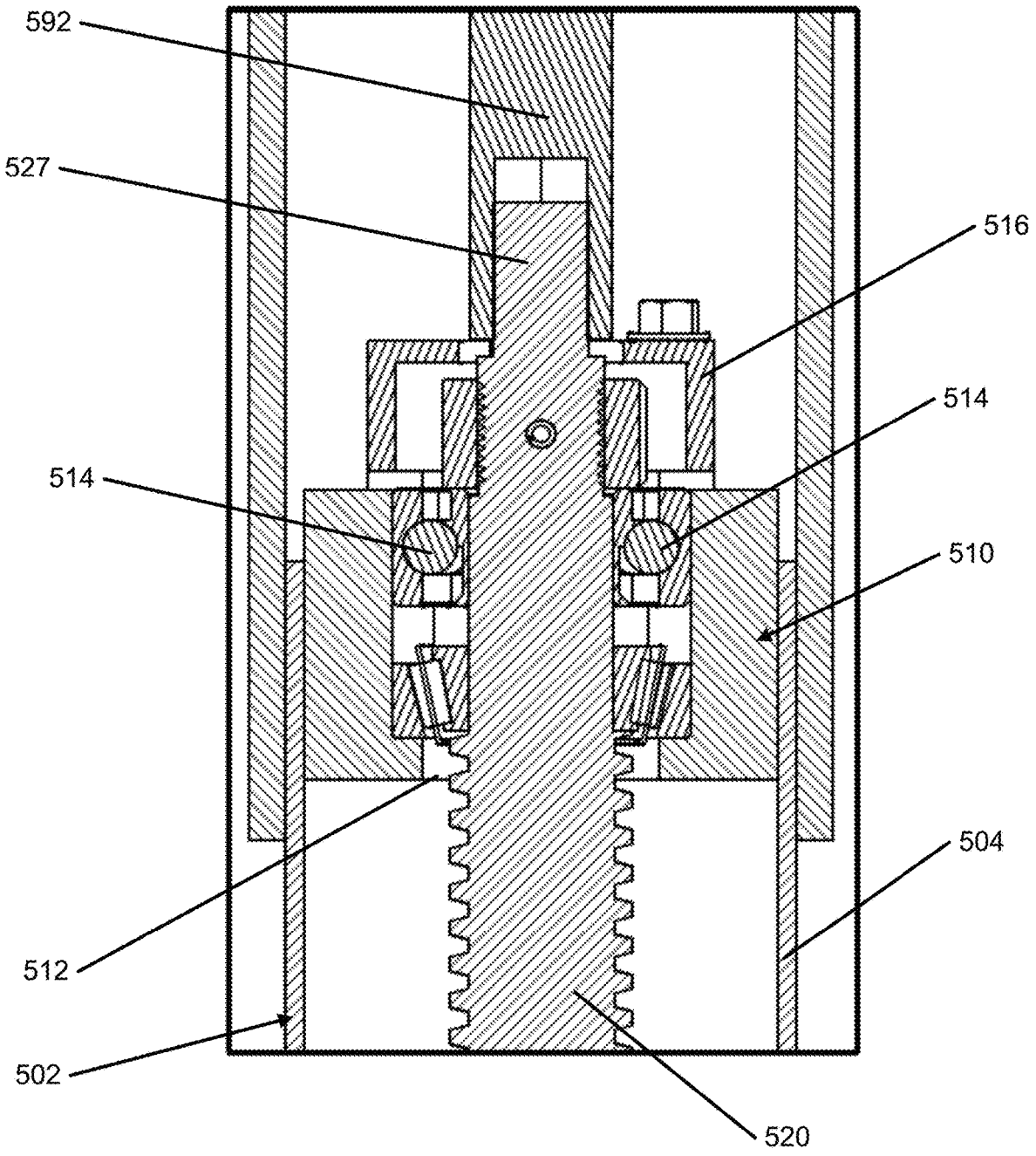
FIG. 17B illustrates a cross-sectional view of detail B of the rail spike remover of FIGS. 16A and 16B.

As illustrated in FIG. 17A, the drive shaft 520 may have a first end 522 and a second end 524 opposite the first end 522. Near the first end 522, the drive shaft 520 may extend through an opening in the bearing 514, through an opening 512 in the bearing housing 510, and through an opening in the cap plate 516. As further illustrated in FIG. 17C, near the second end 524, the drive shaft 520 may connect to the mounting flange 534. The drive shaft 520 may be secured to the mounting flange 534 using a nut 537.

Figure 17C:
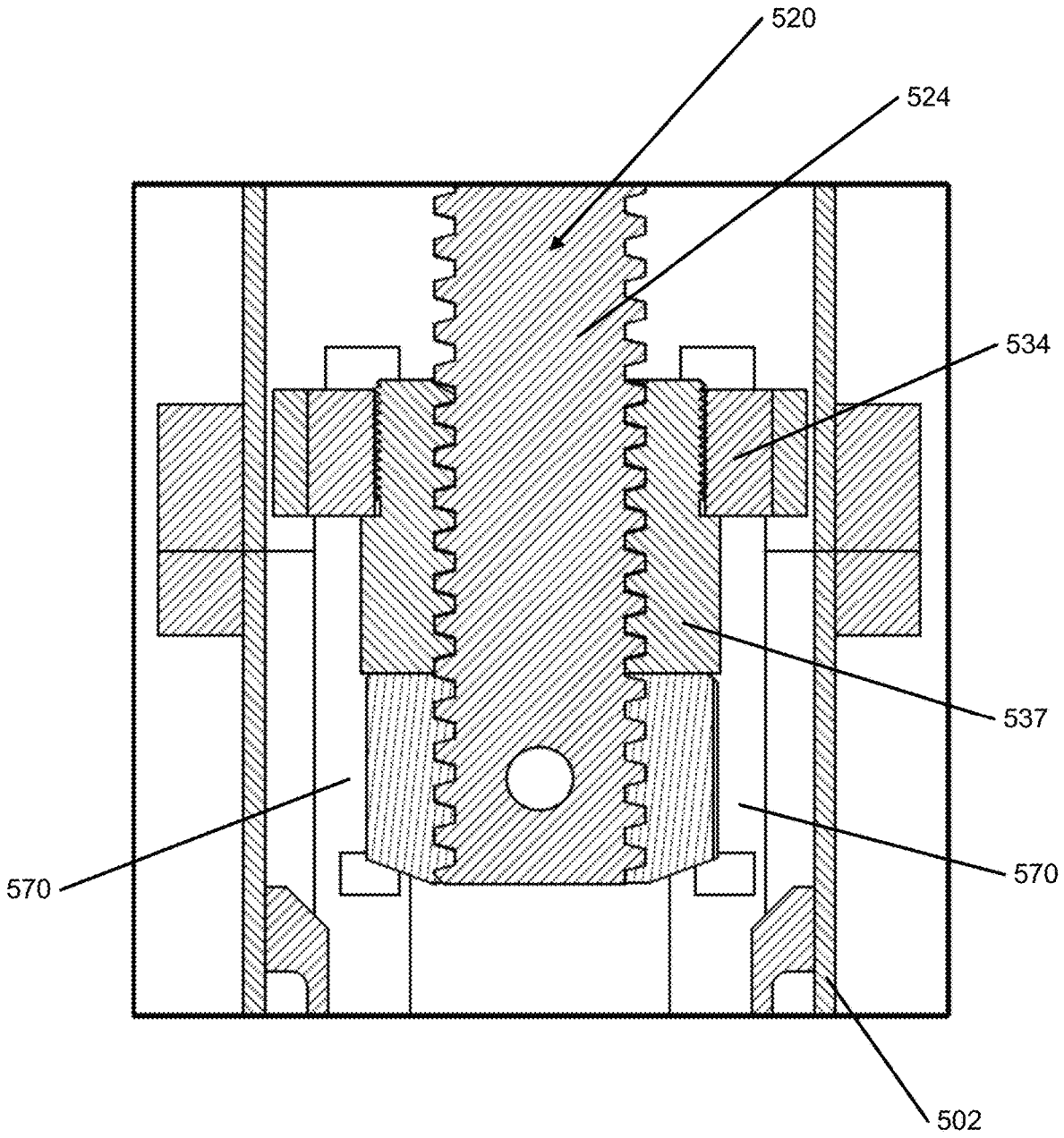
FIG. 17C illustrates a cross-sectional view of detail C of the rail spike remover of FIGS. 16A and 16B.
Figure 17D:
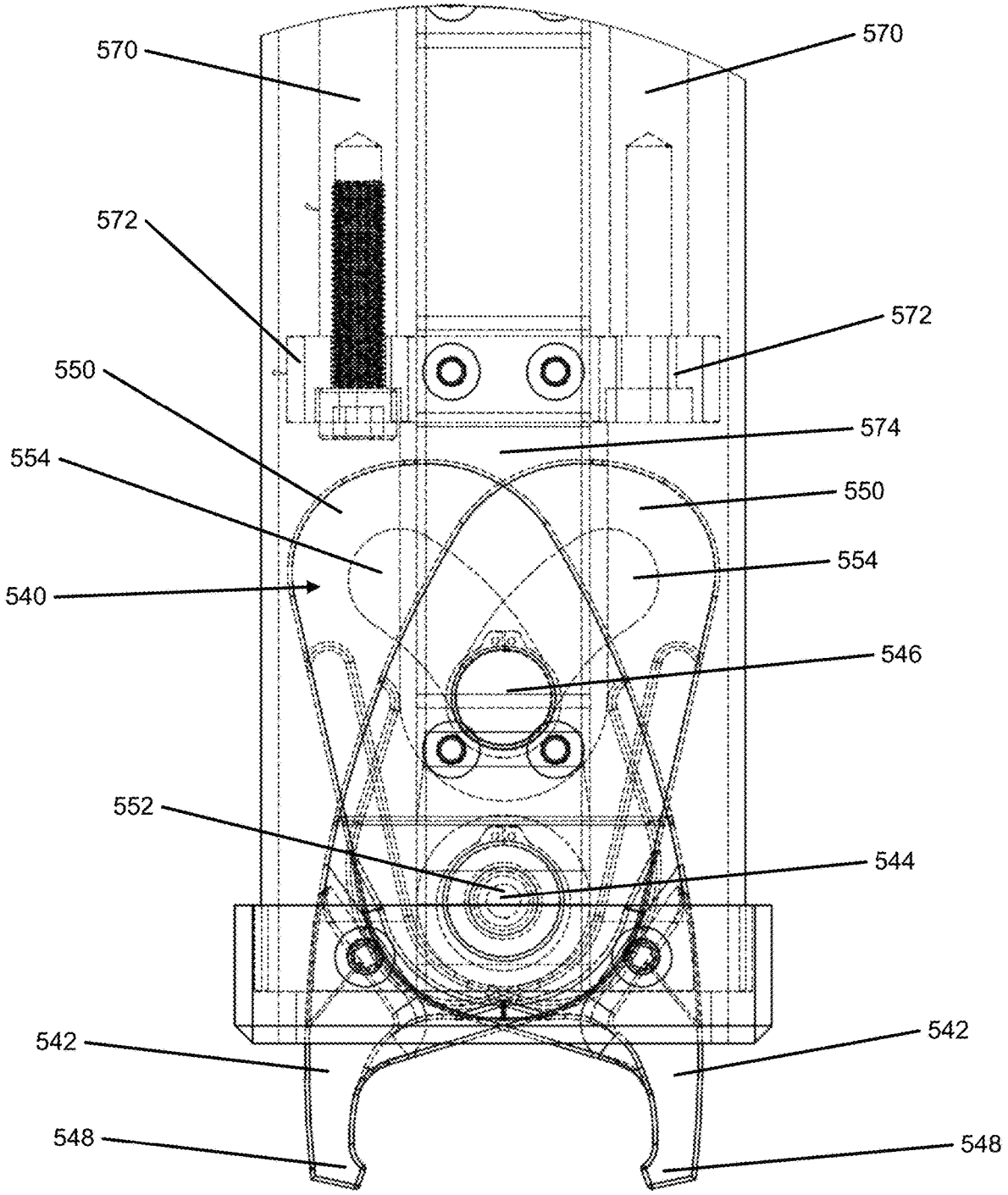
FIG. 17D illustrates a cross-sectional view of detail D of the rail spike remover of FIGS. 16A and 16B.
Figure 18A:
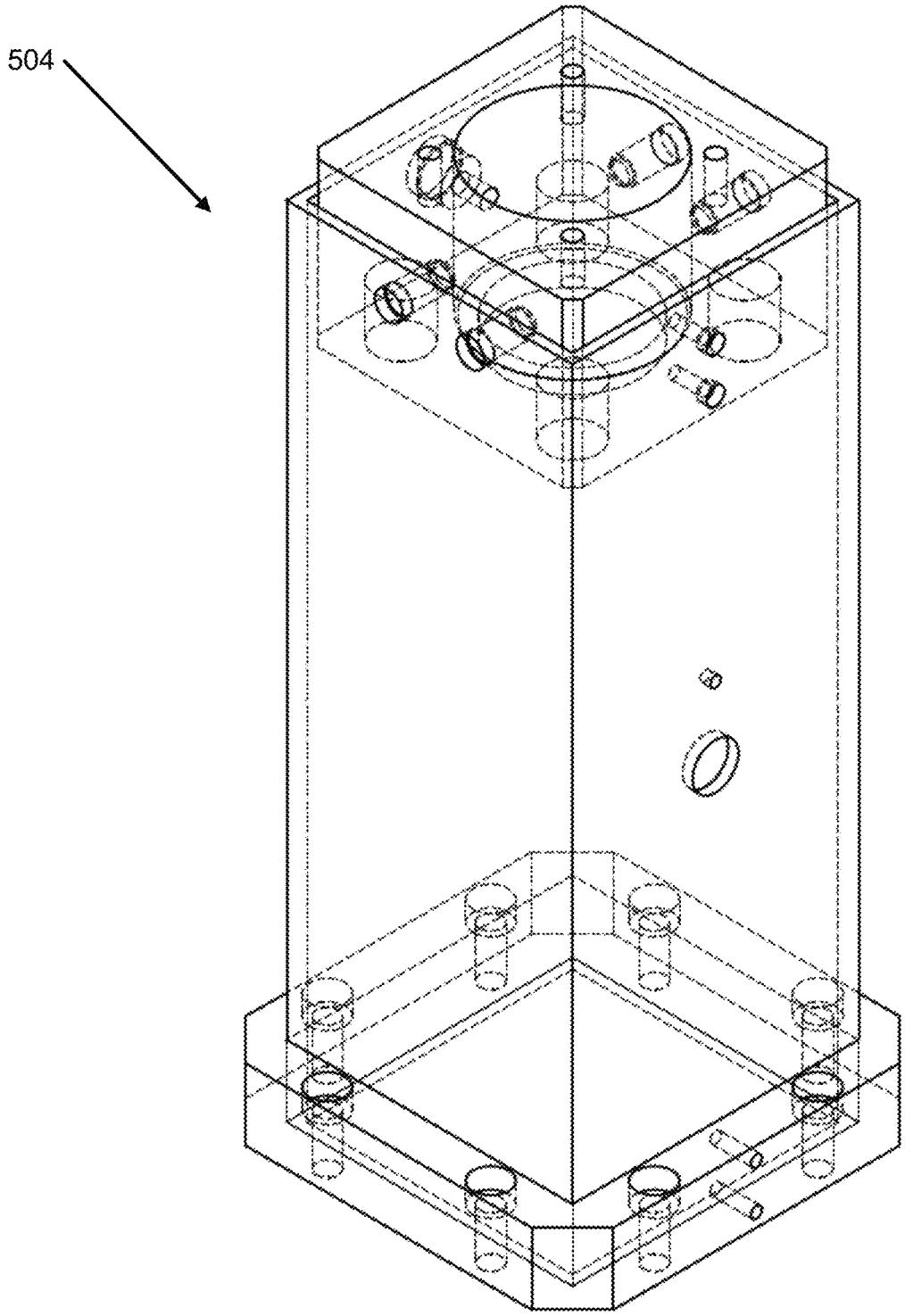
FIGS. 18A-18C illustrate perspective views of an upper housing of the rail spike remover of FIGS. 16A and 16B.
Figure 18B:
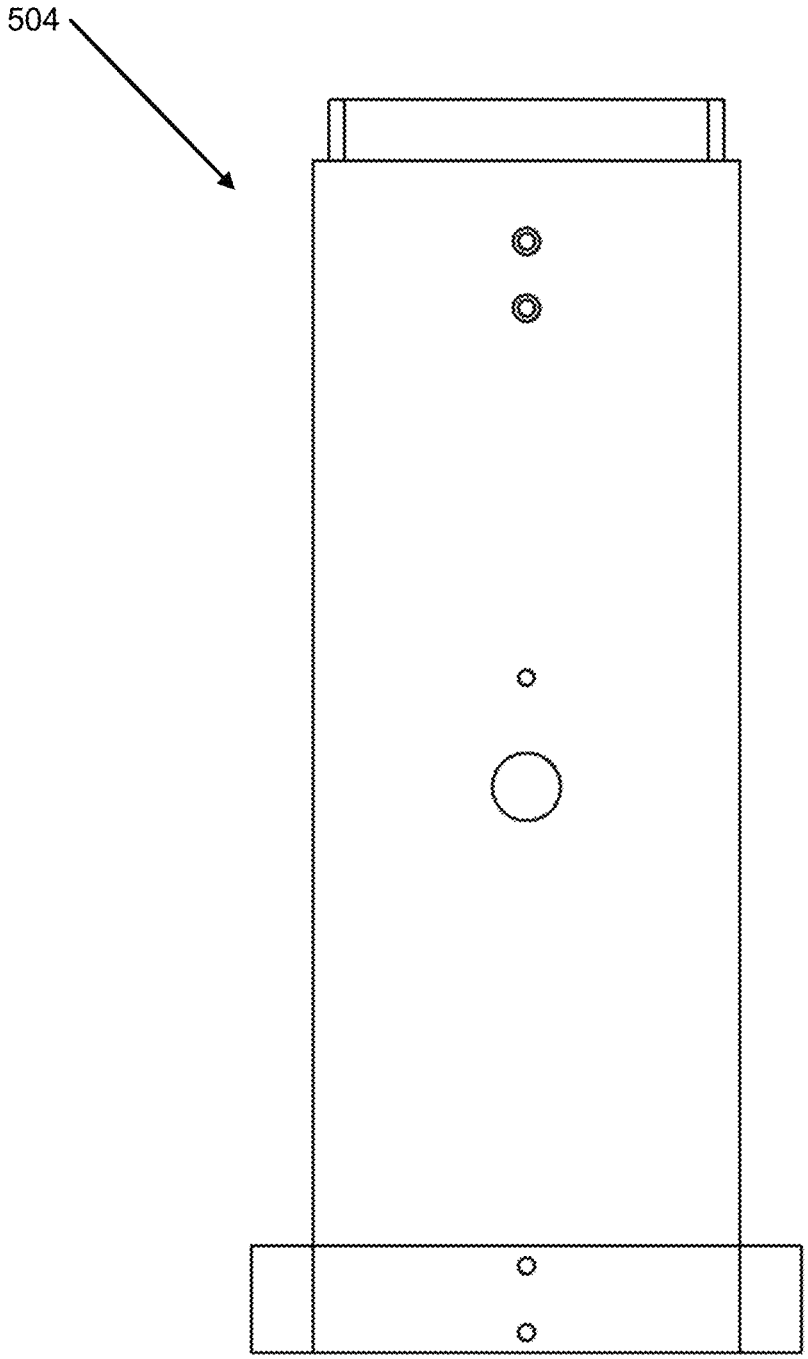
Figure 18C:
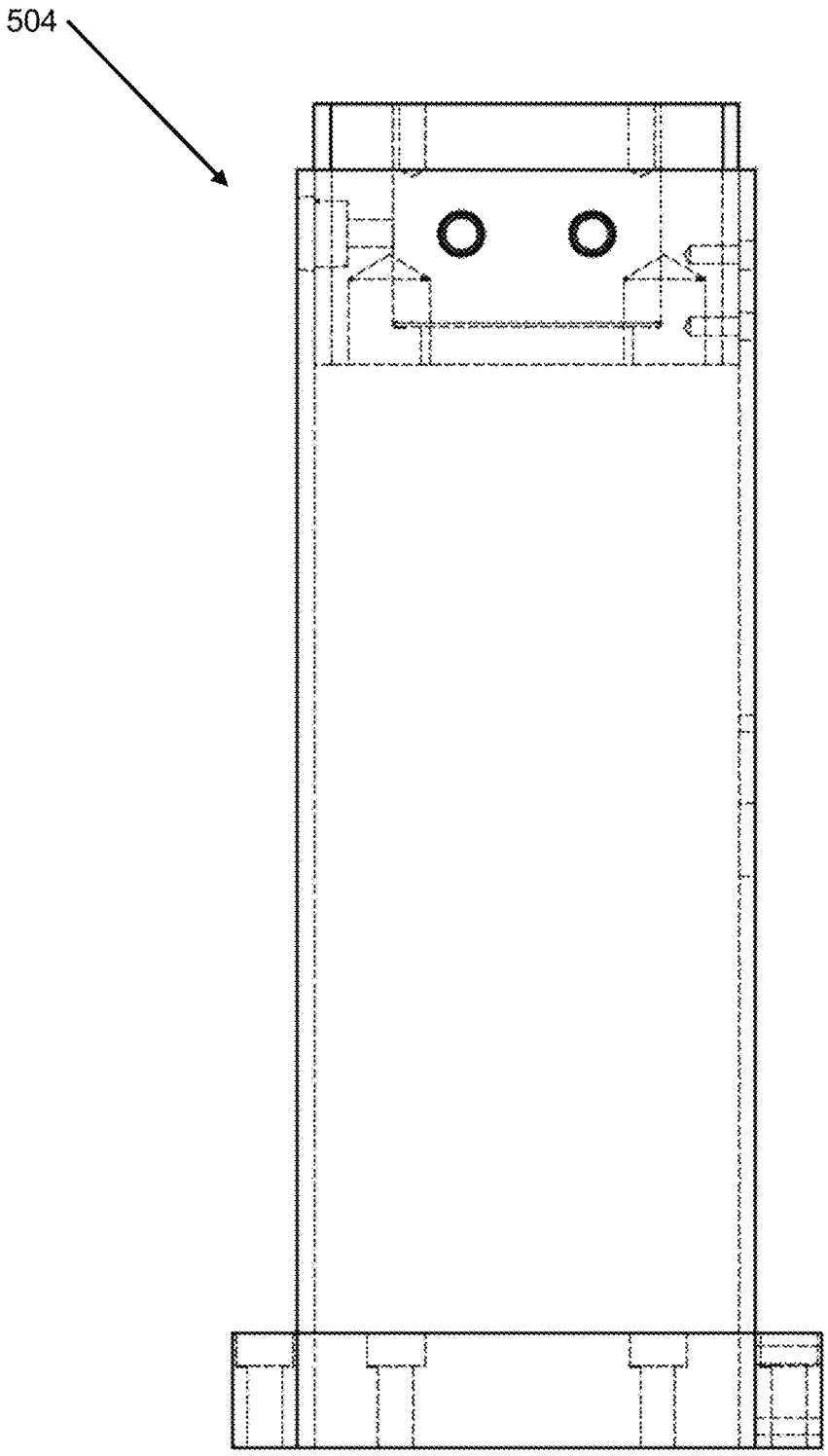
Figure 19A:
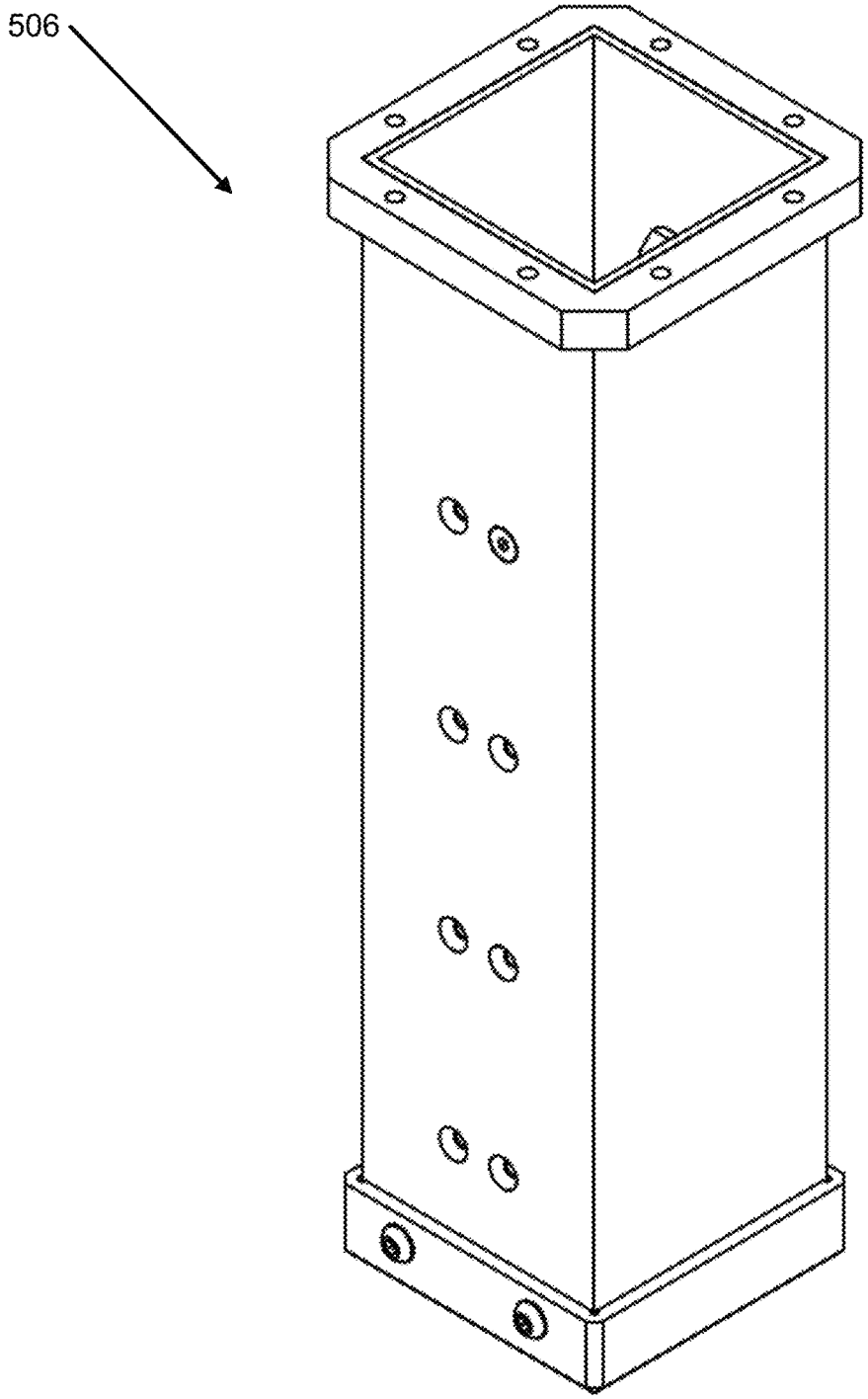
FIGS. 19A and 19B illustrate perspective views of a lower housing assembly of the rail spike remover of FIGS. 16A and 16B.
Figure 19B:
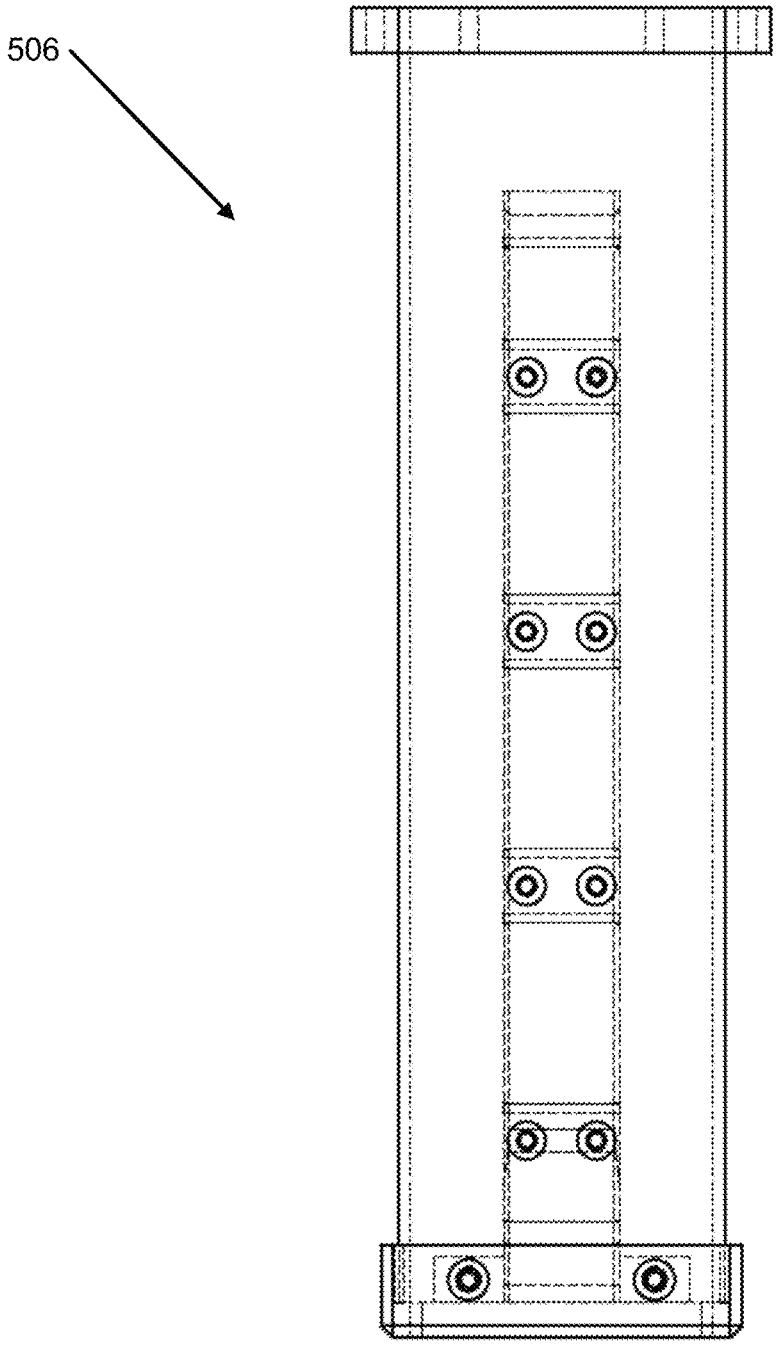

As illustrated in FIGS. 17C and 17D, the plurality of standoffs 570 may connect to the mounting flange 534 at one end and to a clevis pivot plate 572 on the other end. The clevis pivot plate 572 may be attached to a clevis fastener 574 which may then be connected to the extractor 540 or the claw assembly extractor 540.

As further illustrated in FIG. 17D, the extractor 540 comprises a claw assembly extractor 540. Generally, the claw assembly extractor 540 may be designed to open, close, and grab with the drive shaft 520 movement the railroad spike at a force as high as 19,000 pounds. As described above and illustrated for the extractor 340 and FIGS. 10-14, the claw assembly extractor 540 may include a pair of jaws 542 that are pivotally connected to each other by a pivoting pin 544 and a rotating pin 546. The lower ends 548 of the jaws 542 are configured to contact and grab the railroad spike 10. The upper members 550 of the jaws 542 are pivotally connected to the clevis fastener 574 with the rotating pin 546 or the pivoting pin 544 as illustrated in FIG. 17D. When the drive shaft 520 is pulled upward, the jaws 542 move towards a grabbing position to grab onto the railroad spike 10.

The claw assembly extractor 540 includes the two jaws 542, a pivoting pin 544, the two upper members 550, spacer caps, a rotating pin 546, and a friction assembly. The friction assembly generally includes a spring and friction caps. The jaws 542 and upper members 550 form a moveable parallelogram assembly. The jaws 542 each have a pivot hole 552 which the pivot pin 544 is located in. The jaws 542 also each have a rotating section 554 which the rotating pin 546 is located in. The upper members 550 of the jaws 542 are pivotally connected to the jaws 542 by their rotating sections 554 and the rotating pins 546. The upper members 550 of the jaws 542 may be also pivotally connected to the clevis fastener 574 and the clevis pivot plate 572 by the pivoting pin 546.

The friction assembly functions for keeping the jaws 542 in an open position as the jaws 342 are moved from the up position to the home position after a spike 10 has been pulled. Initially, a user places the railroad spike remover 100 over the spike 10 with the jaws 542 in an open position. When the user begins rotation of the drive shaft 520 of the railroad spike remover 500, the drive shaft 520 is moved upward, pulling the upper members 550 upward and rotated pulling the upper members 550 of the jaws 542 towards each other. The friction assembly keeps the centers of the jaws 542 fixed relative to the main housing 502 such that the jaws 542 only initially rotate and do not translate relative to the main housing 502. Thus, the lower ends 548 of the jaws 542 are able to rotate under the head of the spike 10. Then the jaws 542 are stopped by the spike 10 from further rotation and the upward movement of the drive shaft 520 overcomes the frictional forces of the friction assembly and the jaws 542 translate upward along the interior of the main housing 502 pulling the spike 10 with it. When the user releases the movement of the railroad spike remover 100 and rotates the drive shaft 520 downward, the drive shaft 520 is moved downward back towards its home position. The friction assembly initially holds the center of the jaws 542 fixed relative to the main housing 502 such that the jaws 542 only initially rotate and translate to move the jaws 542 to an open position. As the jaws 542 are opened, the spike 10 is able to be released. The jaws 542 stop rotating and start translating down the main housing 502 when the back surfaces of the jaws 542 lower ends contact the opposite interior sides of the main housing 502. The lower ends 548 of the jaws 542 substantially block an area between the main housing 502 and the back surfaces to prevent the spike 10 from entering this area. After the jaws 542 open the downward movement of the drive shaft 520 moves the jaws 542 downward back to their home position while maintaining the jaws 542 in their open position along this home returning movement.

The claw assembly extractor 540 and the jaws 542 includes a frictionally-delayed movement that includes pivoting claws 548 with arms or upper members 550 that frictionally contact each other and/or the main housing 502 when opening and closing the jaws 542. The frictionally-delayed moving jaws 542 function as a means for keeping the jaws 542 in an open position as the jaws 542 are moved from the up position to the home positions after a spike 10 has been pulled.

The main housing 502 may include both an upper housing 504 and a lower assembly housing 506. As illustrated in FIGS. 18A, 18B, 18C, 19A, and 19B, the upper housing 504 and the lower assembly housing 506 may include a plurality of substantially vertical side walls. The main housing 502 may have a height of approximately 24 inches or within a range of 16 to 40 inches or any height. The upper housing 504 may have a height of approximately 10 inches or within a range of 6 to 18 inches or any height. The lower assembly housing 506 may have a height of approximately 14 inches or with a range of 10 to 22 inches or any height. As shown in the exemplary embodiment shown in FIGS. 16A-20C, the main housing 502, the upper housing 504, and the lower assembly housing 506 may generally have a square cross-sectional shape. For example as shown in FIGS. 16A-20C, the main housing 502, the upper housing 504, and the lower assembly housing 506 may have four side walls. Each side wall may have a width of approximately 3.5 inches or within a range of 3 inches to 4 inches, or within a range of 2 inches to 6 inches. Additionally, the upper housing 504 may include a housing handle 508 attached to the upper housing 504. The lower housing assembly 506 may also include a housing handle without departing from the invention.

As shown in FIGS. 16A, 16B, 20A, 20B, and 20C, a T-handle assembly 580 with a battery-operated drill-type tool 582 may be connected to the drive shaft 520 to rotate the drive shaft 520. The first end 522 of the drive shaft 520 may have a drive element 527 to allow a user to engage the drive shaft 520 with the T-handle assembly 580 and the battery-operated drill-type tool 582, such as a high-impact torque wrench or similar device to rotate the drive shaft 520. The battery-operated drill-type tool 582 may include a rechargeable battery pack 583. The drive element 527 may have a hexagonal shape to be engaged by a standard hexagonal high impact socket 592 on the T-handle assembly 580. The standard hexagonal socket may be 0.5 inches or larger. A battery-operated drill-type apparatus or an air hammer attached to a pneumatic supply could be utilized as the rotating tool, thereby engaging the drive shaft 520 and rotating the drive shaft 520 to move the drive shaft 520 up and down. The T-handle assembly 580 may also allow the battery-operated drill-type tool 582 to be easily removed by a user and removed for storage.

As illustrated in FIGS. 20A, 20B, and 20C, the T-handle assembly 580 may include a drill face plate 596 to hold the battery-operated drill-type tool 582. The drill face plate 596 may be connected to a handle plate 594 extending perpendicular to the drill face plate 596. A handle 586 may be extend perpendicular and be connected to the handle plate 594. A handle grip 588 may surround the handle 586 and may be made of a foam material. One or more fastening straps 590 and one or more side plates 584 may be utilized to connect the T-handle assembly 580 to the main housing 502 and specifically to the upper housing 504. The one or more fastening strips 590 may be designed to be quick-connect straps to quickly disconnect the battery-operated drill-type tool 582 from the main housing 502 and upper housing 504 of the railroad spike remover 500. The one or more side plates may extend from and connect to the drill face plate 596. The one or more straps 590 may surround and secure the battery-operated drill-type tool 582 to the drill face plate 596, thereby securing the T-handle assembly 580 to the main housing 502. Additionally, the battery-operated drill-type tool 582 may be attached to an impact socket 592 which then connects to the drive element 527 of the drive shaft 520. The battery-operated drill-type tool 582 may be other similar tools, such as electronic, pneumatic, or other such drill-type tools that will perform similar functionality as a battery-operated drill-type tool 582.

Figure 21A:
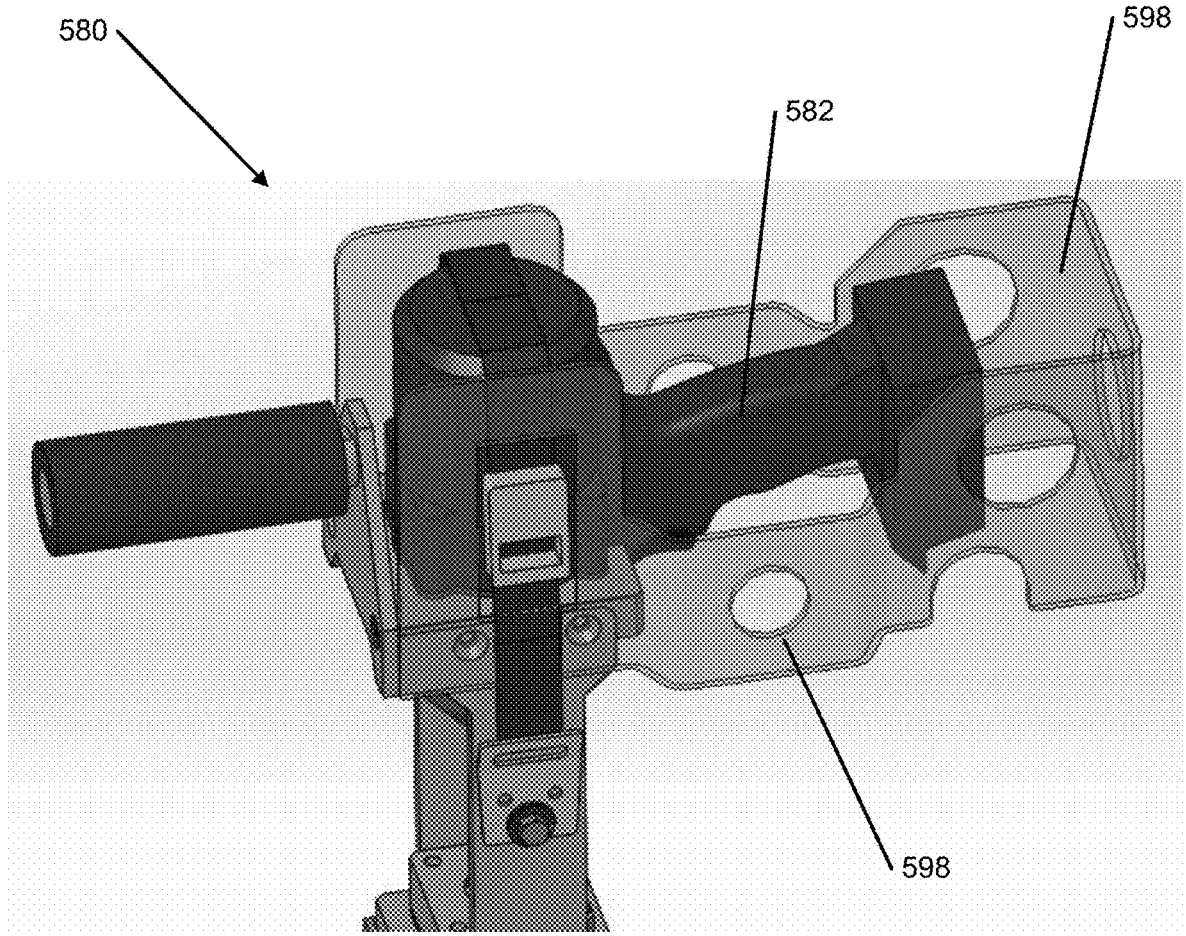
FIGS. 21A and 21B illustrate perspective views of a drill guard assembly for the T-handle assembly of FIGS. 20A-20C.
Figure 21B:
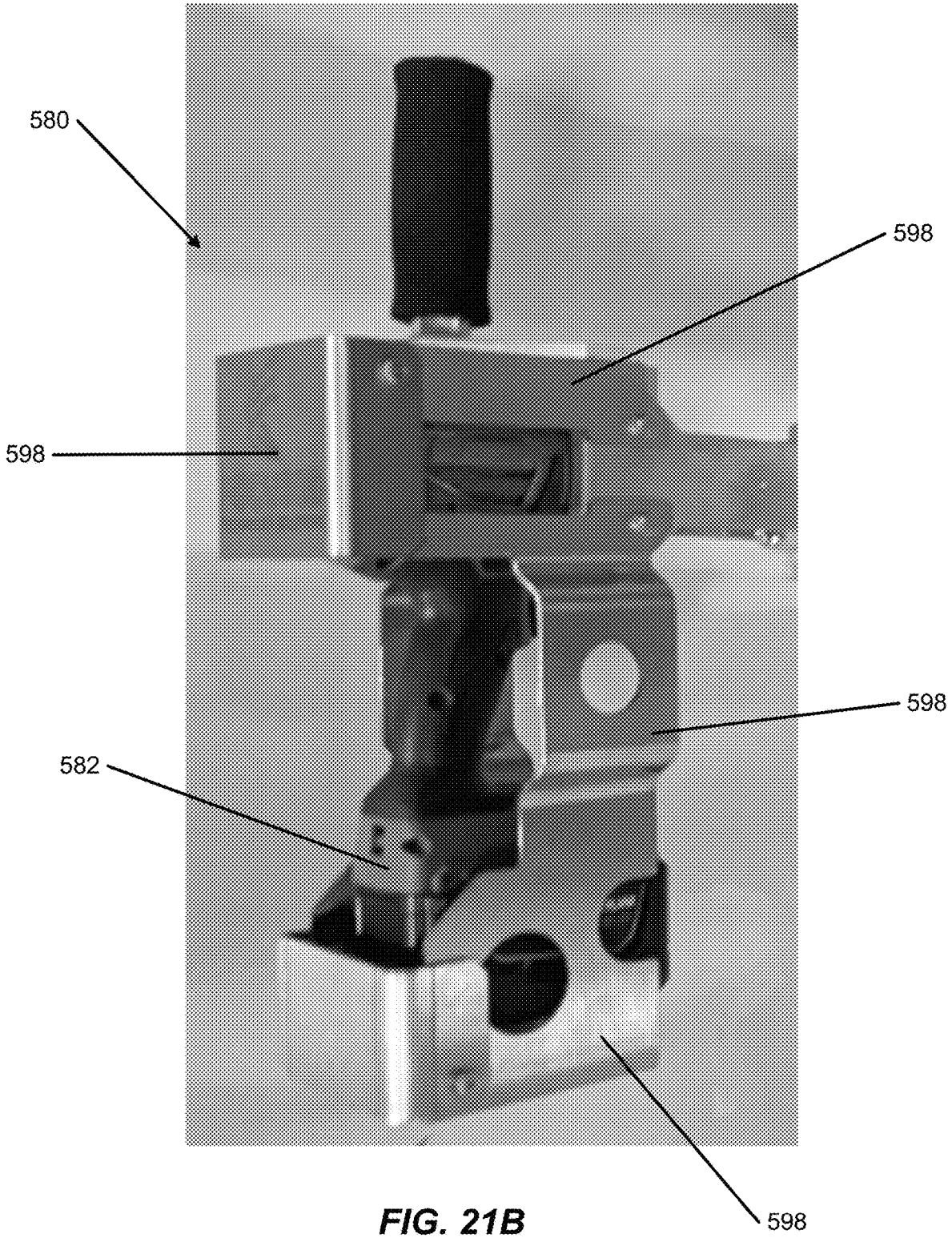

In another embodiment of the present invention, as illustrated in FIGS. 21A and 21B, the T-handle assembly 580 may include a drill guard structure 598. The drill guard structure 598 may be connected to the T-handle assembly 580 and provide a guard for the battery-operated drill-type tool 582. The drill guard structure 598 may include a case over the battery-operated drill-type tool 582 while allowing the user to hole the battery-operated drill-type tool 582. The drill guard structure 598 may include side panels that extend the length of the battery-operated drill-type tool 582 and a back panel that covers the battery area. The drill guard structure 598 may also include front panels that cover the rotating section of the battery-operated drill-type tool 582.

The plurality of standoffs 570 may be hollow tubes that connect at a first end to a mounting flange 534 and a second end of connected to a clevis pivot plate 572. The clevis pivot plate 572 may be attached to a clevis fastener 574 which is then connected to the claw assembly extractor 540. Each standoff 570 may have internal threads such that they may be releasably connected using a threaded fastener on the clevis pivot plate 572. Alternatively, the plurality of standoffs 570 may be integrally joined to the either the mounting flange 534 or the clevis pivot plate 572 or both. Each standoff 570 may be approximately 7 inches long or within a range of 5 inches to 9 inches or within a range of 3 inches to 12 inches. Each of the standoffs 570 may be the same length, but depending on the shape of the either the mounting flange 534, the clevis pivot plate 572, or the extractor 540, each of the standoffs 570 may have different lengths.

The various components for the railroad spike remover 500, such as the main housing 502, the bearing housing 510, the drive shaft 520, the mounting flange 534, the plurality of standoffs 570, the T-handle assembly 580, and the claw assembly extractor 540 may be made of a metallic material, preferably a steel alloy. Alternatively, the components may be made of other metallic materials such as iron, aluminum, an aluminum alloy, titanium, or a titanium alloy.

Figure 22:
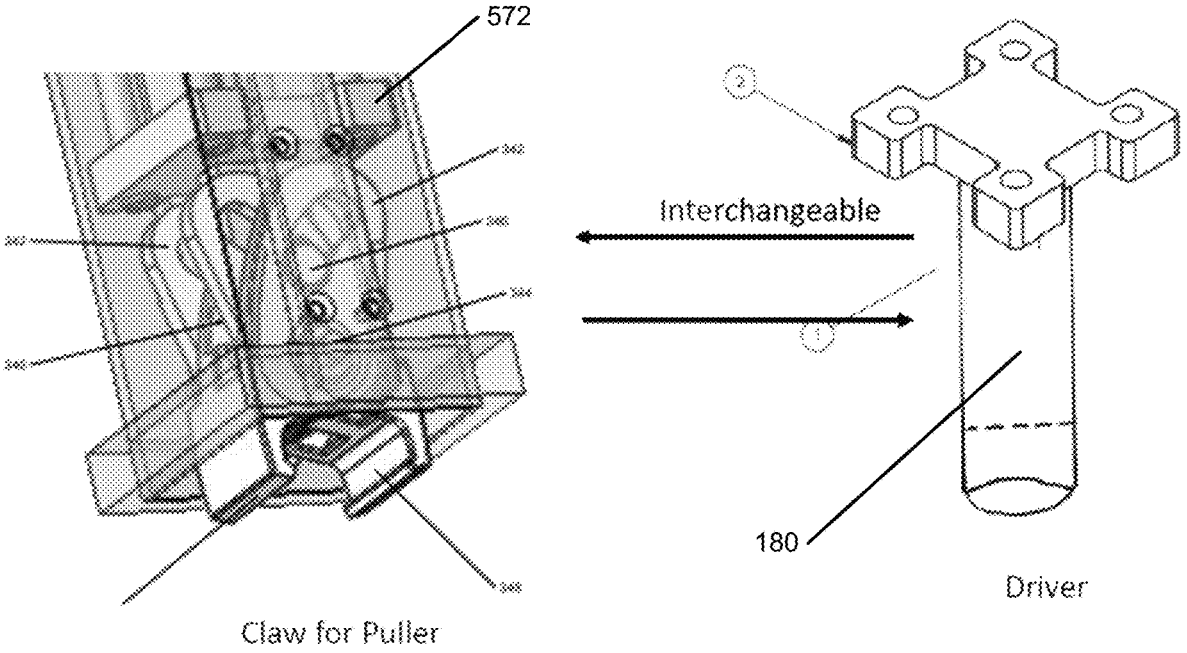
FIG. 22 illustrates a schematic view illustrating the interchangeability of a rail spike driver with the extractor or claw assembly extractor of the rail spike remover of FIGS. 1, 10, 16A, and 16B.
Figure 23:
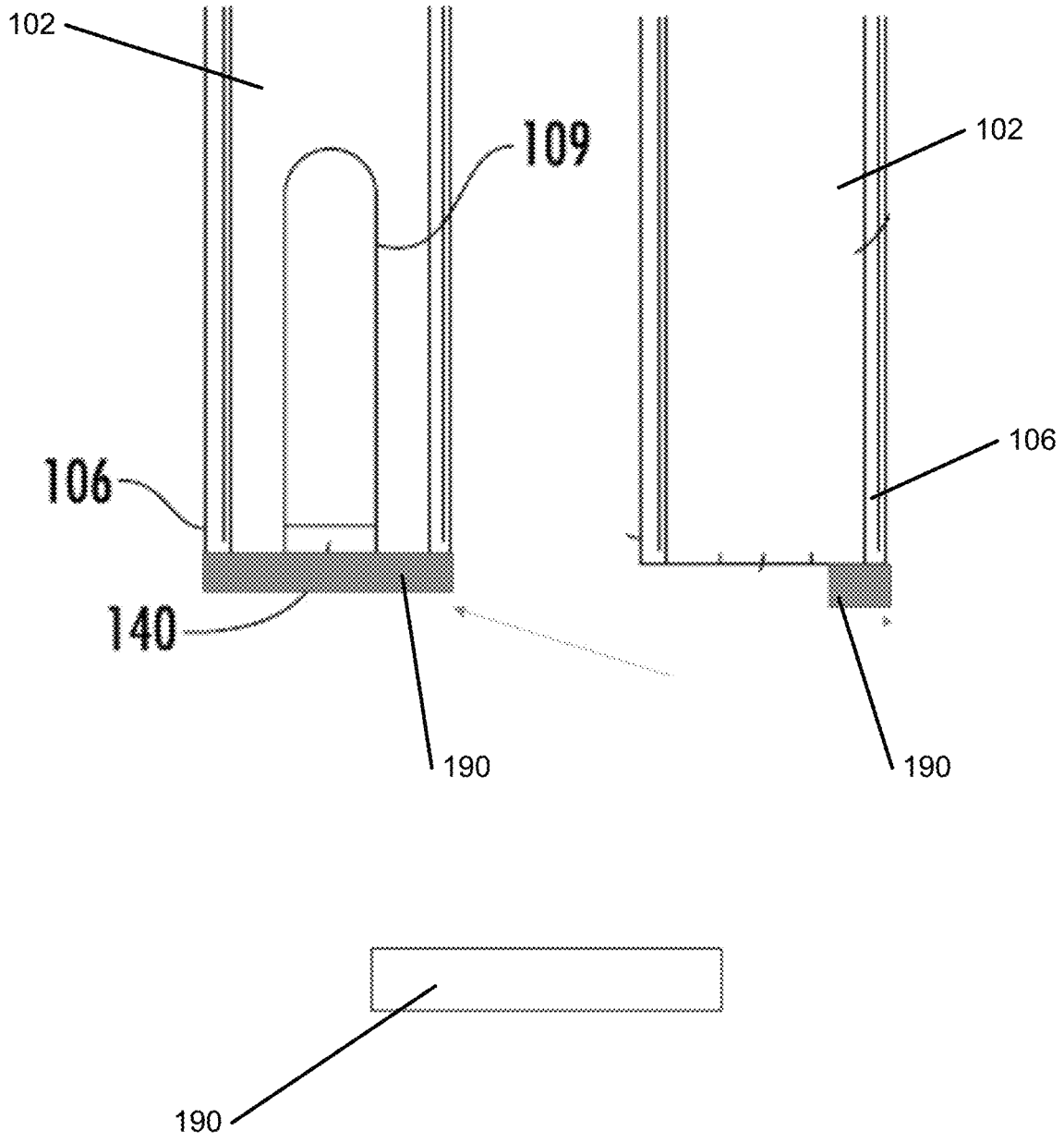
FIG. 23 illustrates a schematic view of a leveling block for use with the rail spike remover of FIGS. 1, 10, 16A, and 16B.

In another embodiment of the present invention, as illustrated in FIG. 22, the rail spike remover 100, 500 may include a quick attachment that allows the rail spike remover to be either a spike puller or a spike driver. The rail spike remover 100, 500 may also include rail spike driver 180 that can be interchangeable with any of the extractor 140, extractor 340, or the claw assembly extractor 540. For example, the rail spike driver 180 may be quickly interchanged with the claw assembly extractor 540 by removing the clevis pivot plate 572 and attaching the rail spike driver 180 to the plurality of standoffs 570. Additionally, and similarly, the rail spike driver 180 may be interchanged with extractor 140 and the extractor 340. The rail spike driver 180 may be utilized In another embodiment of the present invention, as illustrated in FIG. 23, the rail spike remover 100, 500 may include a leveling block 190 for use with the rail spike remover of FIGS. 1, 10, 16A, and 16B. The leveling block 190 may be located on one side of the bottom footer of the second end 106 of the main column 102 or the lower assembly housing 506 of the main housing 502 of the rail spike remover 100, 500. As illustrated in FIG. 23, the leveling block 190 may be rectangular in shape. The leveling block 190 may be utilized to help level the rail spike remover 100, 500 when removing railroad spikes. Additionally, the leveling block 190 may be utilized to help remove the rails flanged angle when pulling railroad spikes.

CONCLUSION

While the invention has been described in detail in terms of specific examples including presently preferred modes of carrying out the invention, those skilled in the art will appreciate that there are numerous variations and permutations of the above described systems and methods.

We claim:

1. A portable apparatus for removing a railroad spike from a rail tie, the apparatus comprising:

a main housing that includes an upper housing and a lower housing, wherein the upper housing includes a bearing housing that contains one or more bearings;

a drive shaft connected to the main housing and a mounting flange, the drive shaft extending through the one or more bearings and an opening in the bearing housing; and a plurality of standoffs with a first end and a second end, with the first end of the plurality of standoffs connected to the mounting flange and the second end of the plurality of standoffs connected to a clevis pivot plate with a clevis fastener that is connected to a claw assembly extractor, wherein the claw assembly extractor includes a pair of jaw members that are pivotally connected to each other by a pivoting pin and a rotating pin, and further wherein each jaw member includes a lower end and a pair of upper members interlocked with each other, the lower ends configured to contact and secure a railroad spike and the pair of upper members pivotally connected to the clevis fastener with the rotating pin, wherein when the drive shaft is rotated, the claw assembly extractor and the mounting flange moves inside the main housing in a vertical direction to extract the railroad spike from the rail tie.

2. The apparatus of claim 1, wherein the drive shaft has a first end and a second end, wherein the first end of the drive shaft includes a drive element and the second end of the drive shaft includes a threaded portion.

3. The apparatus of claim 1, wherein the plurality of standoffs are hollow tubes with a length of between 3 and 12 inches.

4. The apparatus of claim 1, wherein the bearing housing is integrally joined to the main housing.

5. The apparatus of claim 1, wherein when the drive shaft is pulled upward, the pair of jaws move towards a grabbing position to grab onto the railroad spike.

6. The apparatus of claim 1, wherein each of the interlocked upper members include a rotating section in which the rotating pin is located.

7. The apparatus of claim 1, wherein the claw assembly extractor includes a friction assembly that includes a spring and one or more friction caps to keep the jaws in an open position as the jaws are moved from an up position to a home position after a railroad spike has been pulled.

8. The apparatus of claim 1, further including a T-handle assembly to hold a battery-operated drill-type tool that connects to the drive shaft.

9. The apparatus of claim 8, wherein the T-handle assembly includes one or more fastening straps and one or more side plates to connect the T-handle assembly to the main housing.

10. The apparatus of claim 8, wherein the battery-operated drill-type tool includes an impact socket that connects to a drive element of the drive shaft.

11. The apparatus of claim 9, wherein the T-handle assembly includes a handle plate with a handle and a handle grip that surrounds the handle.

12. A portable apparatus for removing a railroad spike from a rail tie, the apparatus comprising:

a main housing that includes an upper housing and a lower housing, wherein the upper housing includes a bearing housing that contains one or more bearings;

a drive shaft connected to the main housing and a mounting flange, the drive shaft extending through the one or more bearings and an opening in the bearing housing;

a T-handle assembly to hold a battery-operated drill-type tool that connects to the drive shaft, wherein the T-handle assembly includes one or more fastening straps and one or more side plates to connect the T-handle assembly to the main housing; and a plurality of standoffs with a first end and a second end, with the first end of the plurality of standoffs connected to the mounting flange and the second end of the plurality of standoffs connected to a clevis pivot plate with a clevis fastener that is connected to a claw assembly extractor, wherein the claw assembly extractor includes a pair of jaw members that are pivotally connected to each other by a pivoting pin and a rotating pin, and further wherein each jaw member includes a lower end and a pair of upper members interlocked with each other, the lower ends configured to contact and secure a railroad spike and the pair of upper members pivotally connected to the clevis fastener with the rotating pin, and further wherein the claw assembly extractor includes a friction assembly that includes a spring and one or more friction caps to keep the jaws in an open position as the jaws are moved from an up position to a home position after a railroad spike has been pulled, wherein when the drive shaft is rotated, the claw assembly extractor and the mounting flange moves inside the main housing in a vertical direction to extract the railroad spike from the rail tie.

13. The apparatus of claim 12, wherein the drive shaft has a first end and a second end, wherein the first end of the drive shaft includes a drive element and the second end of the drive shaft includes a threaded portion.

14. The apparatus of claim 12, wherein the plurality of standoffs are hollow tubes with a length of between 3 and 12 inches.

15. The apparatus of claim 12, wherein the bearing housing is integrally joined to the main housing.

16. The apparatus of claim 12, wherein when the drive shaft is pulled upward, the pair of jaws move towards a grabbing position to grab onto the railroad spike.

17. The apparatus of claim 12, wherein each of the interlocked upper members include a rotating section in which the rotating pin is located.

18. The apparatus of claim 12, wherein the battery-operated drill-type tool includes an impact socket that connects to a drive element of the drive shaft.

19. The apparatus of claim 12, wherein the T-handle assembly includes a handle plate with a handle and a handle grip that surrounds the handle.

20. The apparatus of claim 12, wherein the portable apparatus weighs less than 30 pounds.

21. The apparatus of claim 12, further including a rail spike driver for driving the railroad spike into the rail tie, wherein the rail spike driver is interchangeable with the claw assembly extractor by removing the clevis pivot plate and attaching the rail spike driver to the plurality of standoffs.

22. The apparatus of claim 12, further including a rectangular leveling block located on a side of a bottom footer of the lower housing of the main housing, wherein the leveling block is utilized to level the main housing and the rail spike remover when removing railroad spike.

* * * * *